US007306891B2

(12) United States Patent
Kawauchi

(10) Patent No.: US 7,306,891 B2
(45) Date of Patent: Dec. 11, 2007

(54) INFRARED-SENSITIVE PLANOGRAPHIC PRINTING PLATE PRECURSOR

(75) Inventor: Ikuo Kawauchi, Shizuoka-ken (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/525,969

(22) Filed: Sep. 25, 2006

(65) Prior Publication Data

US 2007/0077518 A1 Apr. 5, 2007

(30) Foreign Application Priority Data

Sep. 27, 2005 (JP) ..... 2005-280810
Sep. 28, 2005 (JP) ..... 2005-282488
May 24, 2006 (JP) ..... 2006-144256

(51) Int. Cl.

| | |
|---|---|
| ***G03C 1/76*** | (2006.01) |
| ***G03C 1/492*** | (2006.01) |
| ***G03C 1/494*** | (2006.01) |
| ***G03C 1/725*** | (2006.01) |
| ***G03C 1/73*** | (2006.01) |

(52) U.S. Cl. ..... 430/270.1; 430/281.1

(58) Field of Classification Search ..... 430/270.1, 430/281.1

See application file for complete search history.

(56) References Cited

U.S. PATENT DOCUMENTS

2006/0216638 A1* 9/2006 Watanabe ..... 430/270.1

FOREIGN PATENT DOCUMENTS

| | | | |
|---|---|---|---|
| DE | 10029157 | A1 | 12/2001 |
| EP | 1 035 443 | A1 | 9/2000 |
| EP | 1 167 063 | A2 | 1/2002 |
| EP | 1 239 328 | A2 | 9/2002 |
| EP | 1 547 769 | A2 | 6/2005 |
| JP | 2002-46363 | A | 2/2002 |
| JP | 2002-254843 | A | 9/2002 |
| JP | 2005-62456 | A | 3/2005 |

* cited by examiner

*Primary Examiner*—Geraldina Visconti
(74) *Attorney, Agent, or Firm*—Sughrue Mion Pllc.

(57) ABSTRACT

Provided is an infrared-sensitive planographic printing plate precursor, including a supporting plate, a recording layer formed on one face of the supporting plate, the recording layer containing a water-insoluble and alkali-soluble resin and an infrared absorbent and forming an image by irradiation of infrared ray, and an organic polymer layer having an arithmetic mean roughness Ra in the range of 0.05 to 0.40 μm, or an anodic oxide film having basis weight of 0.05 to 3.0 g/m$^2$ and an organic polymer layer formed in that order on face of the supporting plate opposite to the recording layer.

10 Claims, 1 Drawing Sheet

INFRARED-SENSITIVE PLANOGRAPHIC PRINTING PLATE PRECURSOR

CROSS REFERENCE TO RELATED APPLICATION

This application claims priority under 35 USC 119 from Japanese Patent Application Nos. 2005-280810, 2005-282488 and 2006-144256, the disclosures of which are incorporated by reference herein.

BACKGROUND OF THE INVENTION

1. Field of the Invention

The invention relates to an infrared-sensitive planographic printing plate precursor and in particular to an infrared-sensitive planographic printing plate precursor resistant to scratching on its photosensitive layer when stacked.

2. Description of the Related Art

Amid recent remarkable progress in laser technology, higher-output and smaller-sized solid-state and semiconductor lasers that emit a laser beam in the near-infrared to infrared region have become more easily available. These lasers are particularly useful in the field of planographic printing as a light source during direct plate making from digital data from, for example, a computer.

The recording layer in a positive-type planographic printing plate precursor for direct plate making using such an infrared laser contains an alkali-soluble resin and an infrared absorbent absorbing light and generating heat as its essential components. The infrared absorbent and the alkali-soluble resin are dissolved in an alkaline developing solution in the exposed region (nonimage region), as the interaction between them is weakened by the heat generated by the infrared absorbent, while the infrared absorbent functions as a solubilization-suppressing agent reducing the solubility of the alkali-soluble resin by interaction with the alkali-soluble resin in the unexposed region (image region), giving an image. However, the mechanical strength of the recording layer in this positive-type planographic printing plate precursor is insufficient, and such a printing plate has the problem that there are defects on the plate surface, leading to image loss in the image region after development when the plate surface is rubbed intensely with various parts during production, processing, transportation of the plate, and handling of the plate surface.

To avoid such a problem, planographic printing plate precursors are generally packaged with an insert paper (partitioning paper) inserted between the plates. However, the insert paper leads to 1) increase costs and 2) problems in disposal, and thus, there exists a need for an insert paper-free process that does not require the insert paper. Recently, in particular, along with the popularization of CTP systems, there has been an increased trend toward installing an auto-loader supplying plate materials into an exposure device, and thus, there is an urgent need for an insert-paper-free process, to avoid the tedious labor of manually removing the insert paper in advance or the problem of scratching during removal of the insert paper even when an automatic insert-paper removing mechanism is installed.

A known method directed toward elimination of the insert paper is to prevent the rear face of a supporting plate from mechanically damaging the photosensitive layer due to contact of the photosensitive layer with the rear face of the supporting plate.

Proposed are, for example, photosensitive planographic printing plates having a coating layer of a resin having a glass transition temperature of 60° C. or higher selected from the group consisting of saturated copolymeric polyester resins, phenoxy resins, polyvinylacetal resins and vinylidene chloride copolymer resins on the face opposite to the photosensitive layer (see, for example, Japanese Patent Application Laid-Open (JP-A) No. 2005-62456), and photosensitive planographic printing plates having a rough-surfaced organic polymer layer on the face opposite to the photosensitive layer (see, for example, JP-A No. 2002-254843).

As described above, methods of using a backcoat layer of an organic polymer are effective to a certain degree in reducing the damage of the photosensitive layer.

However, if a hard coating layer is formed as in JP-A No. 2005-62456, or if a rough-surfaced organic polymer layer is formed as in JP-A No. 2002-254843, it was found that the photosensitive layer was vulnerable to the damage by adhesion of the photosensitive layer with the backcoat layer and to scratches by rubbing between the photosensitive layer and the backcoat layer, particularly when the plate materials are fed, from being stacked without insert paper into an auto-loader, feeding the plate materials automatically to the laser exposure machine, in a structure where the photosensitive layer and the rear face (coated layer or organic polymer layer) are pressed against each other.

In addition, such a planographic printing plate precursor having a backcoat layer and a recording layer relatively lower in strength containing an alkali-soluble resin and an infrared absorbent such as that described above was found to be vulnerable to scratching on the recording layer under load, when the planographic printing plate precursor is coated, dried, and cut into pieces in its production process or when the stacked plate precursors are fed into an auto-loader.

Alternatively, JP-A No. 2002-46363 discloses a recording material for offset printing having a radiation-sensitive layer and an organic polymer-containing backcoat layer that allows stacking without insert paper, which has a backcoat layer of an organic polymer having a glass transition temperature of 35° C. or higher containing a pigment such as silica gel. However, use of an inorganic pigment such as silica gel in the backcoat layer causes the problem of scratching on the photosensitive layer due to rubbing when the products are stacked, packaged, and transported without use of insert paper, because the inorganic pigment is very hard.

There has also been proposed a method of forming a matte on the face opposite to the photosensitive layer by electrostatic spraying (see, for example, JP-A No. 2003-63162). Although it has been reported that the plates could be stacked without insert paper, the plates in such a configuration often resulted in adhesion between plates when stored stacked without insert paper, especially in summer under a high-humidity environment.

The backcoat layer of such an organic polymer is lower in close contact with the supporting plate, and thus, the plate materials are rubbed by each other by vibration and the organic polymer thereon is occasionally exfoliated partially by the stress when the multiple plate materials are stored and transported as stacked. As a result, it is often difficult to reduce the mechanical damage of the photosensitive layer by contact between the photosensitive layer and the rear face of the supporting plate, causing a problem in obtaining an insert-paper-free process.

SUMMARY OF THE INVENTION

The present invention has been made in view of the above circumstances and provides an infrared-sensitive planographic printing plate precursor.

According to an aspect of the invention, provided is an infrared-sensitive planographic printing plate precursor, comprising a supporting plate, a recording layer formed on one face of the supporting plate, the recording layer containing a water-insoluble and alkali-soluble resin and an infrared absorbent and being capable of forming an image by irradiation of an infrared ray, and an organic polymer layer having an arithmetic mean roughness Ra in the range of 0.05 to 0.40 μm formed on a face of the supporting plate opposite to the recording layer.

According to another aspect of the invention, provided is an infrared-sensitive planographic printing plate precursor, comprising a supporting plate, a recording layer formed on one face of the supporting plate, the recording layer containing a water-insoluble and alkali-soluble resin and an infrared absorbent and being capable of forming an image by irradiation of an infrared ray o, and an anodic oxide film having a basis weight of 0.05 to 3.0 g/m$^2$ and an organic polymer layer in that order on a face of the supporting plate opposite to the recording layer.

DETAILED DESCRIPTION OF THE INVENTION

Figure 1:
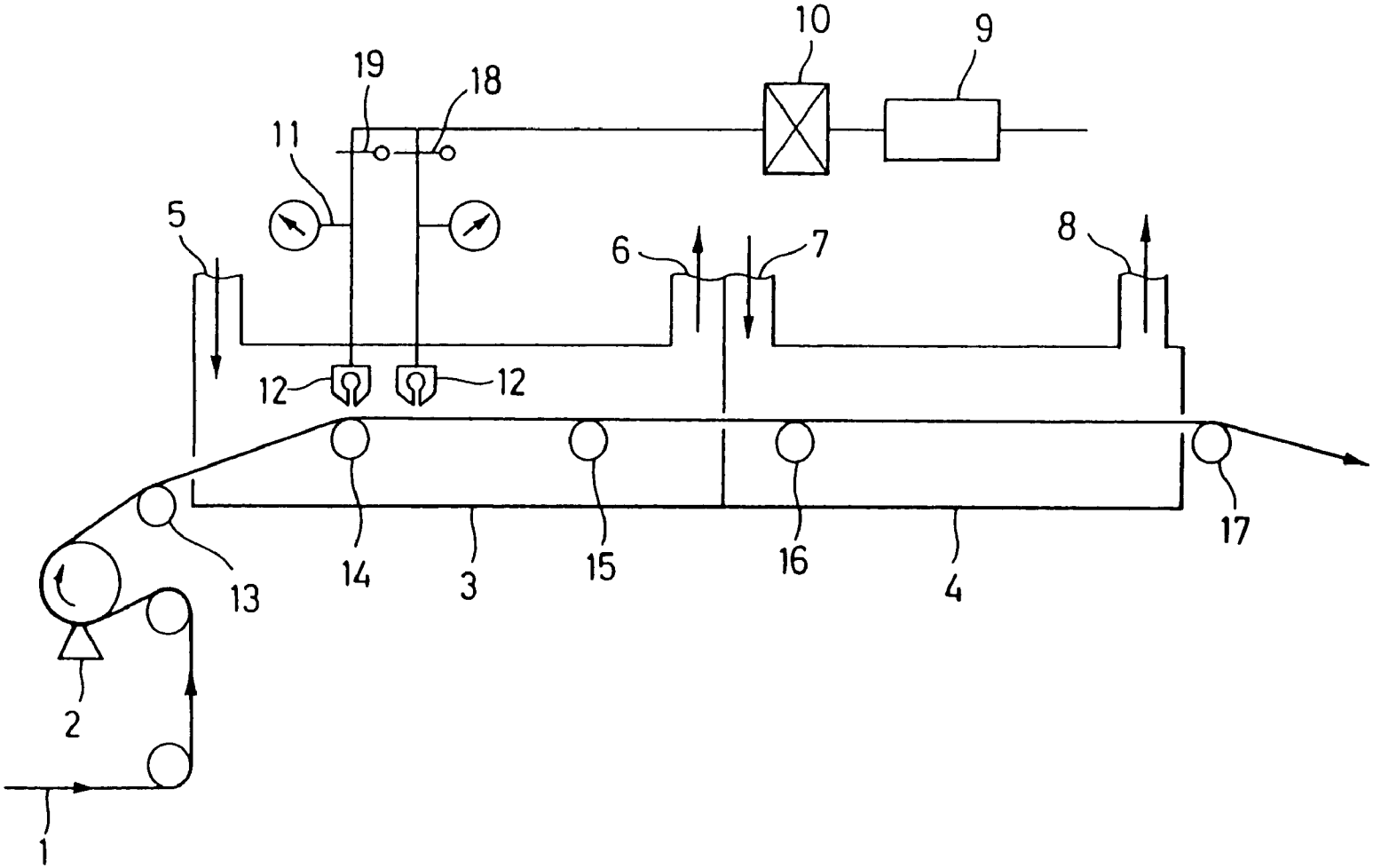
FIG. 1 is a schematic view illustrating the configuration of a continuous coating dryer used in forming the organic polymer layer according to the invention.

After intensive studies, the inventors have found that the following infrared-sensitive planographic printing plate precursors (hereinafter, referred to simply as "planographic printing plate precursors") were effective in solving the problems above, and completed the invention.

<1> an infrared-sensitive planographic printing plate, comprising a precursor supporting plate, a recording layer formed on one face of the supporting plate, the recording layer containing a water-insoluble and alkali-soluble resin and an infrared absorbent and being capable of forming an image by irradiation of an infrared ray, and an organic polymer layer having an arithmetic mean roughness Ra in the range of 0.05 to 0.40 μm formed on the face of the supporting plate opposite to the recording layer;

<2> the infrared-sensitive planographic printing plate precursor of <1>, wherein the organic polymer layer has a matt layer formed on the surface thereof;

<3> the infrared-sensitive planographic printing plate precursor of <1>, wherein the organic polymer layer comprises a matting agent;

<4> the infrared-sensitive planographic printing plate precursor of <3>, wherein the matting agent is a long-chain alkyl group-containing polymer;

<5> the infrared-sensitive planographic printing plate precursor of <4>, wherein the long-chain alkyl group-containing polymer is a polymer selected from the polymers represented by the following Formulae (I), (II), (III), (IV) and (V):

Formula (I)

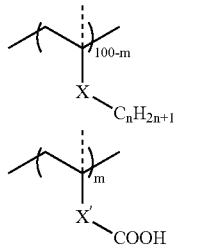

Formula (II)

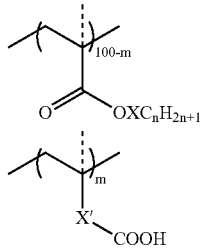

Formula (III)

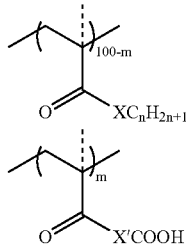

Formula (IV)

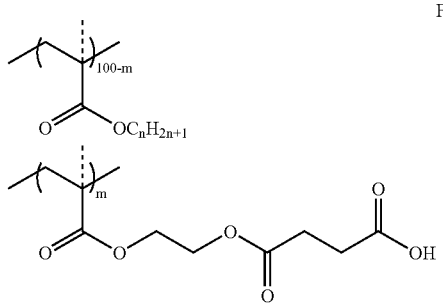

Formula (V)

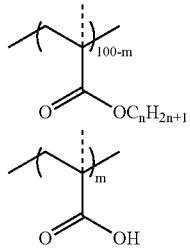

wherein, X and X' each independently represent a bivalent connecting group; m is an integer of 20 to 99; n is an integer of 6 to 40; and a binding site indicated by a dotted line has a methyl group or a hydrogen atom at an end thereof;

<6> the infrared-sensitive planographic printing plate precursor of <4>, wherein the content of the long-chain alkyl group-containing polymer is 0.01 to 30 mass % with respect to the total solid content of the organic polymer layer;

<7> the infrared-sensitive planographic printing plate precursor of <1>, wherein the organic polymer layer is surface-roughened;

<8> the infrared-sensitive planographic printing plate precursor of <1>, wherein the arithmetic mean roughness Ra of the supporting plate is in the range of 0.01 to 0.60 μm;

<9> an infrared-sensitive planographic printing plate precursor, comprising a supporting plate, a recording layer formed on one face of the supporting plate, the recording layer containing a water-insoluble and alkali-soluble resin and an infrared absorbent and being capable of forming an image by irradiation of an infrared ray, and an anodic oxide film having a basis weight of 0.05 to 3.0 g/m$^2$ and an organic polymer layer formed in that order on a face of the supporting plate opposite to the recording layer; and <10> the infrared-sensitive planographic printing plate precursor of <9>, wherein the basis weight of the anodic oxide film is in the range of 0.10 to 2.5 g/m$^2$.

In an embodiment of the invention, when the arithmetic mean roughness Ra of the organic polymer layer is in the range above, the organic polymer layer has a favorable surface which is neither too smooth nor too rough.

For that reason, it seems possible to reduce adhesion between the organic polymer layer and the recording layer and prevent scratches on the contact surface caused by friction under the stress by vibration or the like, even when the plate materials are stacked without insert paper.

In another embodiment of the invention, presence of an anodic oxide film having an basis weight in the range above improves close contact between the supporting plate and the organic polymer layer effectively. It is thus possible to prevent exfoliation of the organic polymer layer and reduce mechanical damage of the recording layer, even when multiple plate materials are stored and transported as stacked and thus rubbed by each other.

Thus, the invention provides an infrared-sensitive planographic printing plate precursor that is free from the troubles, for example, of improper adhesion and of scratching of the recording layer during transportation and storage even when stacked without insert paper and that can be used favorably in exposure devices equipped with auto-loader.

The infrared-sensitive planographic printing plate precursor in an embodiment of the invention comprises a supporting plate, a recording layer containing a water-insoluble and alkali-soluble resin and an infrared absorbent and forming an image by irradiation of infrared ray formed on one face of the supporting plate, and an organic polymer layer having an arithmetic mean roughness Ra in the range of 0.05 to 0.40 μm formed on the face thereof opposite to the recording layer.

The arithmetic mean roughness Ra of the organic polymer layer in the embodiment is preferably in the range of 0.10 to 0.35 μm and more preferably in the range of 0.15 to 0.30 μm.

An arithmetic mean roughness Ra of less than 0.05 μm often results in adhesion of the surfaces of neighboring printing plates when the printing plate is coated, dried, cut and stacked during its production process or brought under a load in an auto-loader as they are stacked. Alternatively, an arithmetic mean roughness Ra of more than 0.40 μm often results in generation of the scratches due to rubbing between the printing plates by vibration during transportation and handling.

In the invention, the arithmetic mean roughness Ra is determined according to the method described in JIS B0601-1994 (the disclosure of which is incorporated by reference herein). More specifically in the invention, the arithmetic mean roughness Ra of the organic polymer layer is determined by using a needle profilometer.

The arithmetic mean roughness Ra of the organic polymer layer is controlled in the range above specifically by the following means: These means may be used alone or in combination of two or more.

1) A matt layer is formed on an organic polymer layer;

2) A matting agent (e.g., a long-chain alkyl group-containing polymer) is added to an organic polymer layer;

3) The surface of an organic polymer layer is roughened; and

4) The surface roughness of a supporting plate is adjusted.

The matt layer used in means 1) is not particularly limited, if it does not damage the function of the organic polymer layer, and examples thereof include matt layers prepared by spraying an aqueous solution or dispersion containing the resin described in JP-A No. 57-34558, and the matt layers described in JP-A No. 50-125805 and JP-B Nos. 57-6582, 61-28986, and 62-62337.

Specifically in method 2), a long-chain alkyl group-containing polymer having the following structure is preferably added internally.

Favorable examples of the long-chain alkyl group-containing polymers for use in the invention include copolymers represented by the following Formula (I) copolymer.

Formula (I)

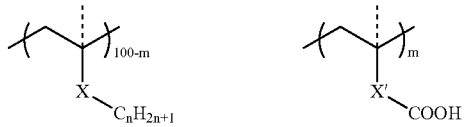

In Formula (I), X and X' each independently represent a bivalent connecting group. m is an integer of 20 to 99, preferably 30 to 90, and still more preferably 45 to 80. n is an integer of 6 to 40, preferably 12 to 30 and more preferably 14 to 20. The binding site indicated by dotted line has a methyl group or a hydrogen atom at the end.

Typical examples of the bivalent connecting groups represented by X and X' in Formula (I) include straight-chain, branched or cyclic alkylene groups having 1 to 20 carbon atoms, straight-chain, branched or cyclic alkenylene groups having 2 to 20 carbon atoms, alkynylene groups having 2 to 20 carbon atoms, arylene groups (monocyclic and heterocyclic rings) having 6 to 20 carbon atoms, —OC(═O)—, —OC(═O)Ar—, —OC(═O)O—, —OC(═O)OAr—, —C(═O)NR—, —C(═O)NAr—, —$SO_2$NR—, —$SO_2$NAr—, —OR—(alkyleneoxy or polyalkyleneoxy), —OAr—(aryleneoxy or polyaryleneoxy), —C(═O)O—, —C(═O)O—Ar—, —C(═O)Ar—, —C(═O)—, —$SO_2$O—, —$SO_2$OAr—, —$OSO_2$—, —$OSO_2$Ar—, —N$RSO_2$—, —N$ArSO_2$—, —NRC(═O)—, —NArC(═O)—, —NRC(═O)O—, —NArC(═O)O—, —OC(═O)NR—, —OC(═O)NAr—, —NAr—, —NR—, —$N^+$RR'—, —$N^{+RAr}$—, —$N^+$ArAr'—, —S—, —SAr—, —ArS—, heterocyclic groups (three—to twelve—membered monocyclic and fused rings containing at least one hetero atoms such as nitrogen, oxygen and sulfur), —OC(═S)—, —OC(═S)Ar—, —C(═S)O—, —C(═S)OAr—, —C(═S)OAr—, —C(═O)S—, —C(═O)SAr—, —ArC(═O)—, —ArC(═O)NR—, —ArC(═O)NAr—, —ArC(═O)O—, —ArC(═O)S—, —ArC(═S)O—, —ArO—, —ArNR—, and the like. In the groups above, R and R' each independently represent a hydrogen atom or a straight-chain or branched, linear or cyclic alkyl, alkenyl or alkynyl group. Ar and Ar' each independently represent an aryl group.

The connecting group above may be a connecting group in combination of two or more of the groups above.

Favorable among the connecting groups above are arylene groups having 6 to 20 carbon atoms (monocyclic and heterocyclic rings), —C(=O)NR—, —C(=O)NAr—, —OR—(alkyleneoxy or polyalkyleneoxy), —OAr—(aryleneoxy or polyaryleneoxy), —C(=O)O—, —C(=O)O—Ar—, —C(=O)—, —C(=O)Ar—, —S—, —SAr—, —ArS—, —ArC(=O)—, —ArC(=O)O—, —ArO—, and —ArNR—; and more preferably are arylene groups having 6 to 20 carbon atoms (monocyclic and heterocyclic rings), —C(=O)NR—, —C(=O)NAr—, —OR—(alkyleneoxy or polyalkyleneoxy), —OAr—(aryleneoxy or polyaryleneoxy), —C(=O)O—, —C(=O)O—Ar—, —SAr—, —ArS—, —ArC(=O)—, —ArC(=O)O—, —ArO—, —ArNR—, and the like.

The connecting group may have one or more substituent groups, and examples of the substituent groups include straight-chain, branched or cyclic alkyl groups having 1 to 20 carbon atoms, straight-chain, branched or cyclic alkenyl groups having 2 to 20 carbon atoms, alkynyl groups having 2 to 20 carbon atoms, aryl groups having 6 to 20 carbon atoms, acyloxy groups having 1 to 20 carbon atoms, alkoxycarbonyloxy group having 2 to 20 carbon atoms, aryloxycarbonyloxy groups having 7 to 20 carbon atoms, carbamoyloxy groups having 1 to 20 carbon atoms, carbonamido groups having 1 to 20 carbon atoms, sulfonamido groups having 1 to 20 carbon atoms, carbamoyl groups having 1 to 20 carbon atoms, sulfamoyl groups having 0 to 20 carbon atoms, alkoxy groups having 1 to 20 carbon atoms, aryloxy groups having 6 to 20 carbon atoms, aryloxycarbonyl groups having 7 to 20 carbon atoms, alkoxycarbonyl groups having 2 to 20 carbon atoms, N-acylsulfamoyl groups having 1 to 20 carbon atoms, N-sulfamoylcarbamoyl groups having 1 to 20 carbon atoms, alkylsulfonyl groups having 1 to 20 carbon atoms, arylsulfonyl groups having 6 to 20 carbon atoms, alkoxycarbonylamino groups having 2 to 20 carbon atoms, aryloxycarbonylamino groups having 7 to 20 carbon atoms, amino groups having 0 to 20 carbon atoms, imino groups having 1 to 20 carbon atoms, ammonio groups having 3 to 20 carbon atoms, a carboxy group, a sulfo group, an oxy group, a mercapto group, alkylsulfinyl groups having 1 to 20 carbon atoms, arylsulfinyl groups having 6 to 20 carbon atoms, alkylthio groups having 1 to 20 carbon atoms, arylthio groups having 6 to 20 carbon atoms, ureido groups having 1 to 20 carbon atoms, heterocyclic groups having 2 to 20 carbon atoms, acyl groups having 1 to 20 carbon atoms, sulfamoylamino group having 0 to 20 carbon atoms, silyl groups having 2 to 20 carbon atoms, a hydroxy group, halogen atoms (such as fluorine, chlorine, and bromine), a cyano group, a nitro group, and the like.

The long-chain alkyl group-containing polymer is more preferably, for example, an acrylic copolymer represented by the following Formula (II).

Formula (II)

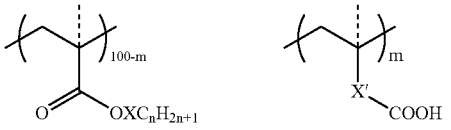

In Formula (II), X and X' each independently represent a single bond or a bivalent connecting group. X and X' in Formula (II) are the same as X and X' in Formula (I) above, and the favorable examples thereof are also the same. m is an integer of 20 to 99, preferably 30 to 90, and still more preferably 45 to 80. n is an integer of 6 to 40, preferably 12 to 30, and more preferably 14 to 20. The binding site indicated by dotted line has a methyl group or a hydrogen atom at the end.

The long-chain alkyl group-containing polymer is still more preferable, for example, an acrylic copolymer represented by the following Formula (III).

Formula (III)

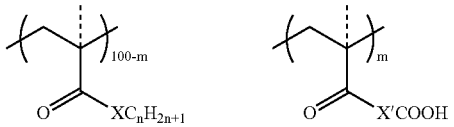

In Formula (III), X and X' each independently represent a bivalent connecting group. X and X' in Formula (III) are the same as X and X' in Formula (I) above, and the favorable examples thereof are also the same. m is an integer of 20 to 99, preferably 30 to 90, and still more preferably 45 to 80. n is an integer of 6 to 40, preferably 12 to 30, and more preferably 14 to 20. The binding site indicated by dotted line has a methyl group or a hydrogen atom at the end.

The long-chain alkyl group-containing polymer is most preferably, for example, an acrylic copolymer represented by the following Formula (IV) or (V).

Formula (IV)

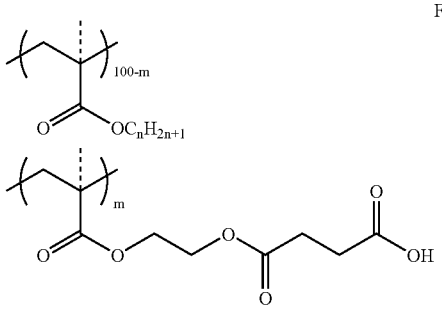

Formula (V)

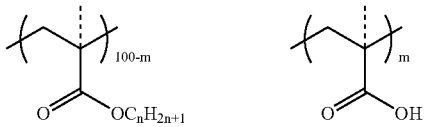

In Formula (IV) and Formula (V), m is an integer of 20 to 99, preferably 30 to 90, and still more preferably 45 to 80. n is an integer of 6 to 40, preferably 12 to 30, and more preferably 14 to 20. The binding site indicated by dotted line has a methyl group or a hydrogen atom at the end.

<Hydrophilic Monomer>

The monomer copolymerized with the long-chain alkyl group-containing monomer and the carboxy group-containing vinyl monomer is, for example, a hydrophilic monomer.

The hydrophilic monomer is preferably an acidic group-containing monomer represented by the following group (1) to (5), from the points of solubility in alkaline developing solution and sensitivity:

(1) phenol group (—Ar—OH);

(2) sulfonamide group (—$SO_2$NH—R);

(3) active imide group (—$SO_2NHCOR$, —$SO_2NHSO_2R$, or —$CONHSO_2R$);

(4) sulfonic acid group (—$SO_3H$); or (5) phosphoric acid group (—$OPO_3H_2$).

In the groups (1) to (5), Ar represents a bivalent aryl connecting group that may be substituted; and R represents a hydrocarbon group that may be substituted.

Examples of the monomers having a phenol group (1) include acrylamides, methacrylamides, and acrylic and methacrylic esters having a phenol group, hydroxystyrene, and the like.

Examples of the monomers having the sulfonamide group (2) include compounds having one or more sulfonamide groups in the structure above and one or more polymerizable unsaturated groups in the molecule. Among them, low-molecular weight compounds having an acryloyl, allyl, or vinyloxy group and a sulfonamido group in the molecule are preferable. Typical examples thereof include the compounds represented by the following Formulae (i) to (v).

(i)

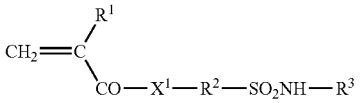

(ii)

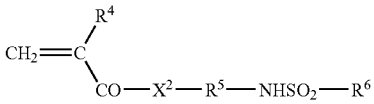

(iii)

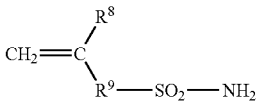

(iv)

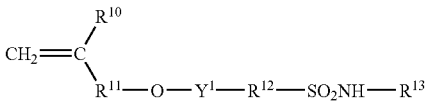

(v)

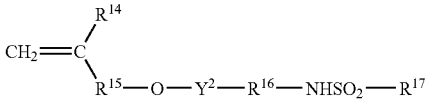

In Formulae (i) to (v) above, $X^1$and $x^2$ each independently represent —O—or —$NR^7$—. $R^1$ and $R^4$ each independently represent a hydrogen atom or —$CH_3$. $R^2$, $R^5$, $R^9$, $R^{12}$, and $R^{16}$ each independently represent an alkylene, cycloalkylene, arylene or aralkylene group having 1 to 12 carbon atoms that may be substituted. $R^3$, $R^7$, and $R^{13}$ each independently represent a hydrogen atom, or an alkyl, cycloalkyl, aryl or aralkyl group having 1 to 12 carbon atoms that may be substituted. $R^6$ and $R^{17}$ each independently represent a hydrogen atom or an alkyl, cycloalkyl, aryl or aralkyl group having 1 to 12 carbon atoms that may be substituted. $R^8$, $R^{10}$ and $R^{14}$ each independently represent a hydrogen atom or —$CH_3$. $R^{11}$ and $R^{15}$ each independently represent a single bond or an alkylene, cycloalkylene, arylene or aralkylene group having 1 to 12 carbon atoms that may be substituted. $Y^1$ and $Y^2$ each independently represent a single bond or —CO—.

In particular among the compounds represented by Formulae (i) to (v), m-aminosulfonylphenyl methacrylate, N-(p-aminosulfonylphenyl)methacrylamide, N-(p-aminosulfonylphenyl)acrylamide, or the like is used favorably for the planographic printing plate precursor according to the invention.

Examples of the monomers having the active imide group (3) include compounds having one or more active imide groups represented by the structural formula above and one or more polymerizable unsaturated groups in the molecule. Among them, preferable are the compounds having one or more active imide groups represented by the following formula and one or more polymerizable unsaturated groups in the molecule.

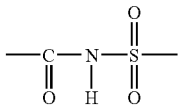

Specific favorable examples thereof include N-(p-toluenesulfonyl)methacrylamide, N-(p-toluenesulfonyl)acrylamide, and the like.

Examples of the monomers having the sulfonic acid group (4) include compounds having one or more sulfonic acid groups and one or more polymerizable unsaturated groups in the molecule.

Examples of the monomers having the phosphoric acid group (5) include compounds having one or more phosphoric acid groups and one or more polymerizable unsaturated groups in the molecule.

Among the hydrophilic monomers above, monomers having a phenol group (1), a sulfonamide group (2), or an active imide group (3) are preferably; and monomers having a phenol group (1) or a sulfonamide group (2) are particularly preferable, from the points of solubility in alkaline developing solutions, development latitude, and film strength.

<Other Monomer>

Examples of other monomers copolymerized with the long-chain alkyl group-containing monomer and the carboxy group-containing vinyl monomer include the following compounds (6) to (16):

(6) aliphatic hydroxyl group-containing acrylic and methacrylic esters such as 2-hydroxyethyl acrylate and 2-hydroxyethyl methacrylate;

(7) acrylates such as methyl acrylate, ethyl acrylate, propyl acrylate, amyl acrylate, benzyl acrylate, 2-chloroethyl acrylate, glycidyl acrylate, N-dimethylaminoethyl acrylate, polyethylene glycol monoacrylate, and polypropylene glycol monoacrylate;

(8) methacrylates such as methyl methacrylate, ethyl methacrylate, propyl methacrylate, amyl methacrylate, cyclohexyl methacrylate, benzyl methacrylate, 2-chloroethyl methacrylate, glycidyl methacrylate, N-dimethylaminoethyl methacrylate, polyethylene glycol monomethacrylate, and polypropylene glycol monomethacrylate;

(9) acrylamides and methacrylamideacrylamides such as acrylamide, methacrylamide, N-methylolacrylamide, N-ethylacrylamide, N-hexylmethacrylamide, N-cyclohexylacrylamide, N-hydroxyethylacrylamide, N-phenylacrylamide, N-nitrophenylacrylamide, and N-ethyl-N-phenylacrylamide;

(10) vinyl ethers such as ethyl vinylether, 2-chloroethyl vinylether, hydroxyethyl vinylether, propyl vinylether, butyl vinylether, and phenyl vinylether;

(11) vinyl esters such as vinyl acetate, vinyl chloroacetate, vinyl butyrate, and vinyl benzoate;

(12) styrenes such as styrene, α-methylstyrene, methylstyrene, and chloromethylstyrene;

(13) vinylketones such as methyl vinylketone, ethyl vinylketone, propyl vinylketone, and phenyl vinylketone;

(14) olefins such as ethylene, propylene, isobutylene, butadiene, and isoprene;

(15) N-vinylpyrrolidone, N-vinylcarbazole, 4-vinylpyridine, acrylonitrile, methacrylonitrile, and the like; and

(16) unsaturated imides such as maleimide, N-acryloylacrylamide, N-acetylmethacrylamide, N-propionylmethacrylamide, and N-(p-chlorobenzoyl)methacrylamide.

Any one of known copolymerization methods such as graft copolymerization, block copolymerization, and random copolymerization may be used for copolymerization of the long-chain alkyl group-containing monomer, carboxy group-containing vinyl monomer, hydrophilic monomer, and, and other monomers.

In addition, these monomers may be used respectively in combination of two or more in the copolymerization. When the carboxy group-containing monomers are used in combination of two or more, the total mole ratio of the monomers is preferably in the range of 20 to 99 mol %.

Typical examples of the long-chain alkyl group-containing polymers used in the invention include, but are not limited to, the following polymers.

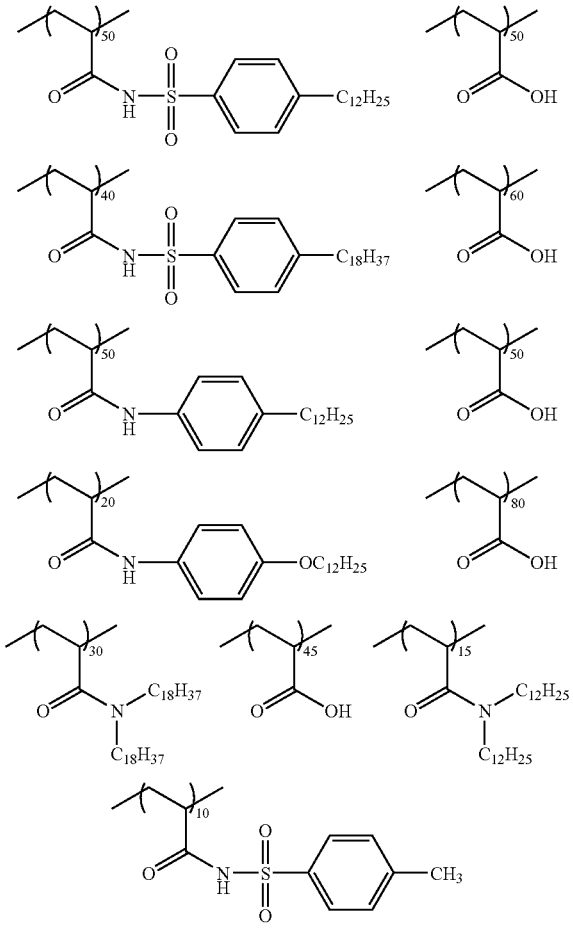

-continued

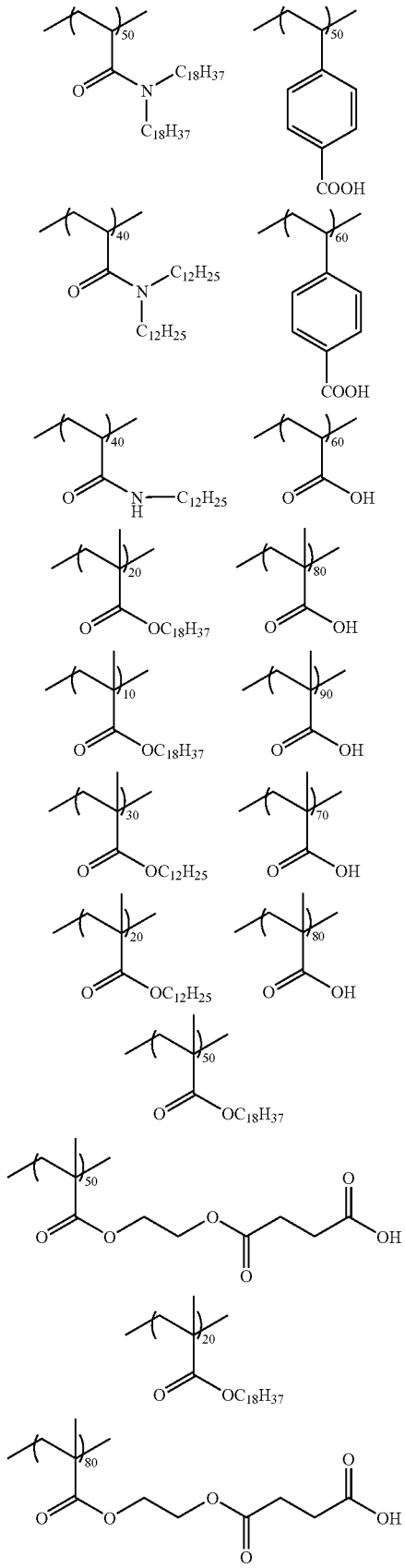

-continued
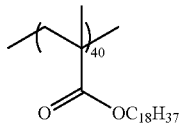
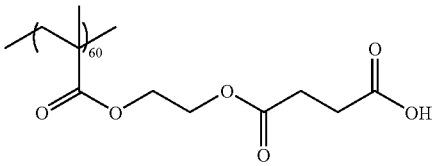
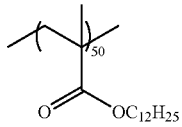
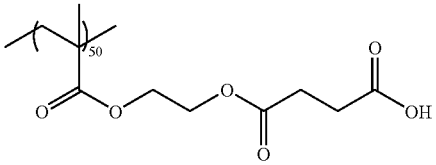
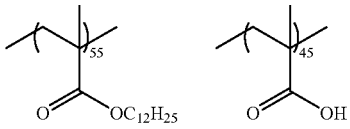
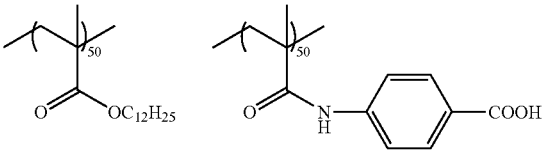
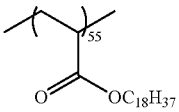
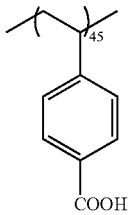
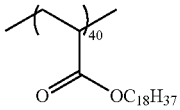
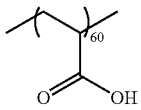
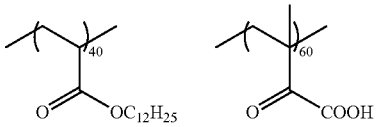
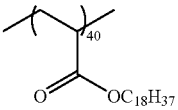
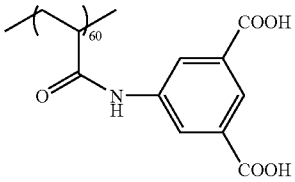
-continued
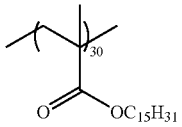
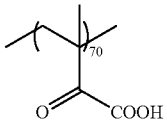
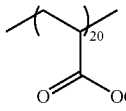
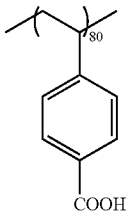
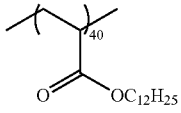
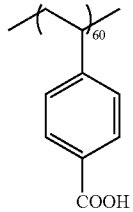
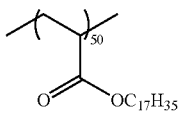
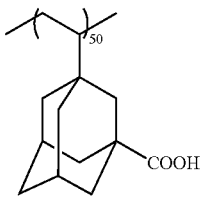
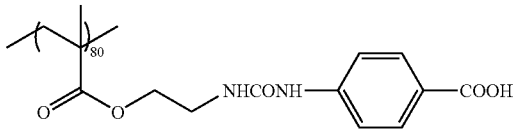
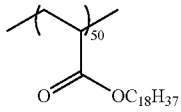
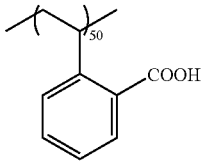
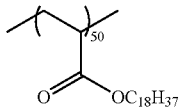
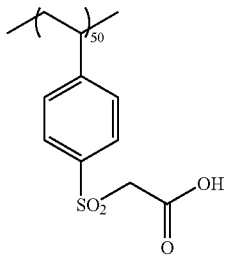
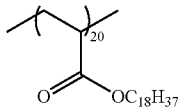

-continued
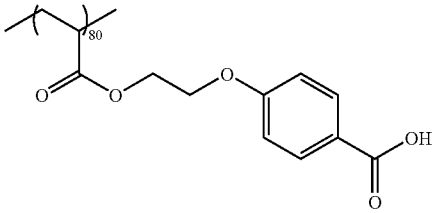
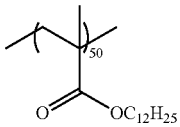
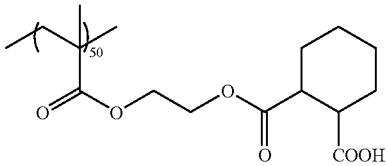
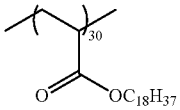
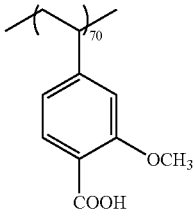
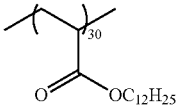
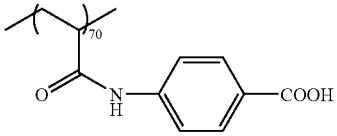
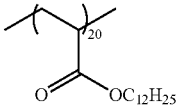
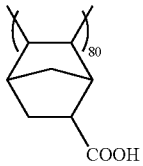
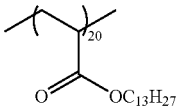
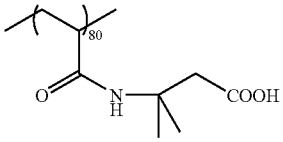
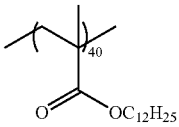
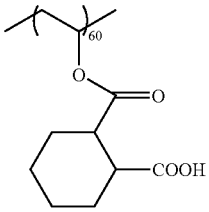
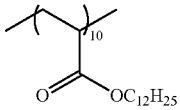
-continued
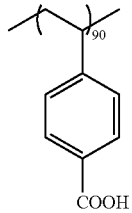
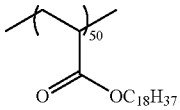
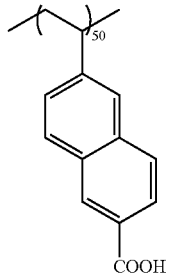
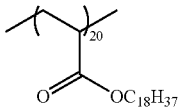
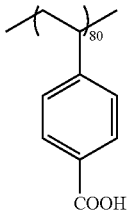
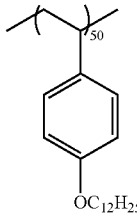
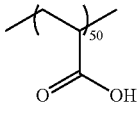
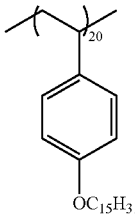
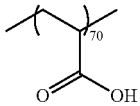
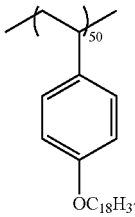
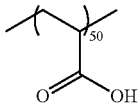
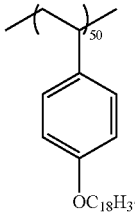
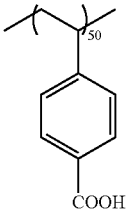

-continued
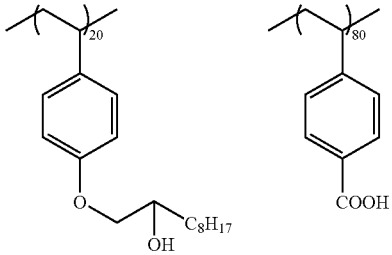
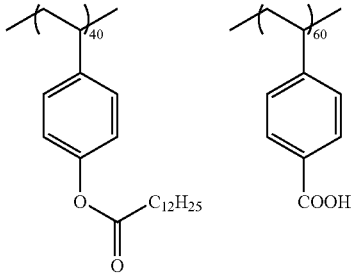
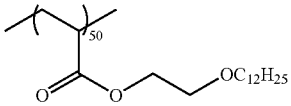
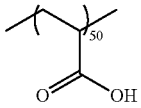
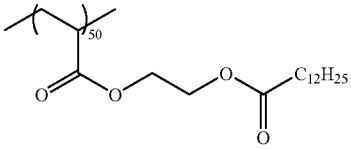
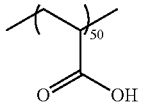
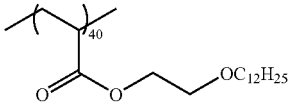
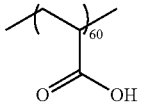
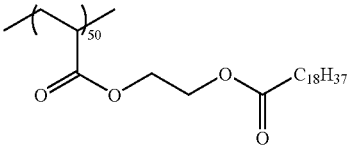
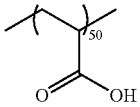
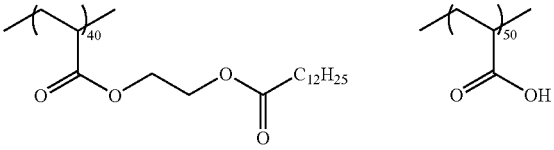
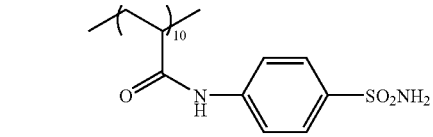
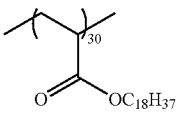
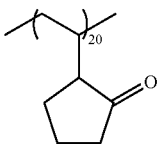
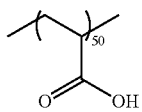
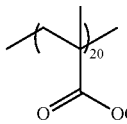
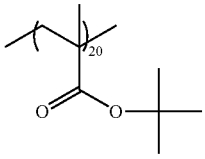
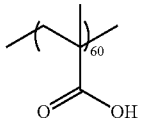
-continued
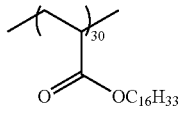
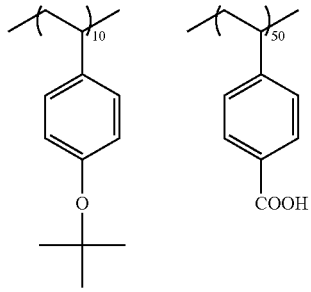
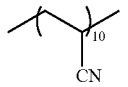
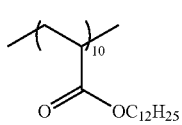
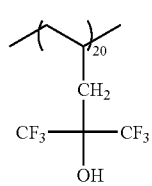
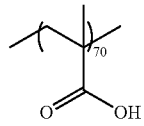
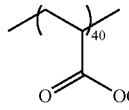
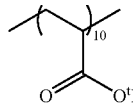
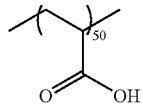
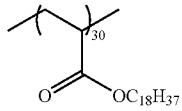
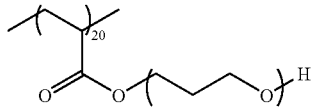
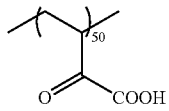
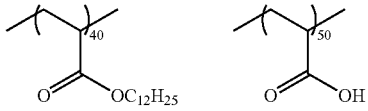
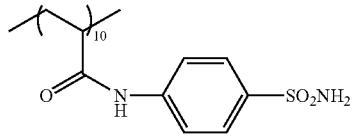
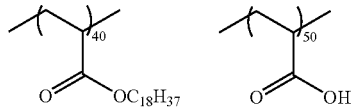
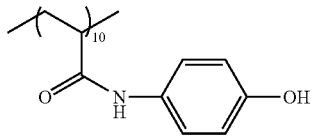
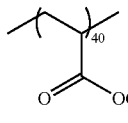
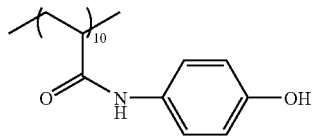
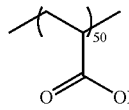

-continued

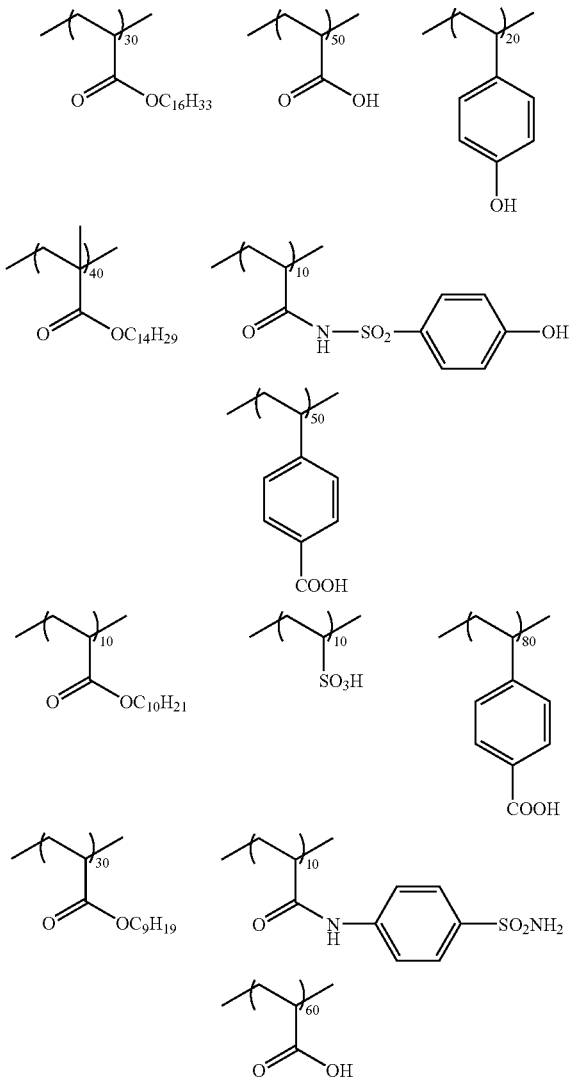

-continued

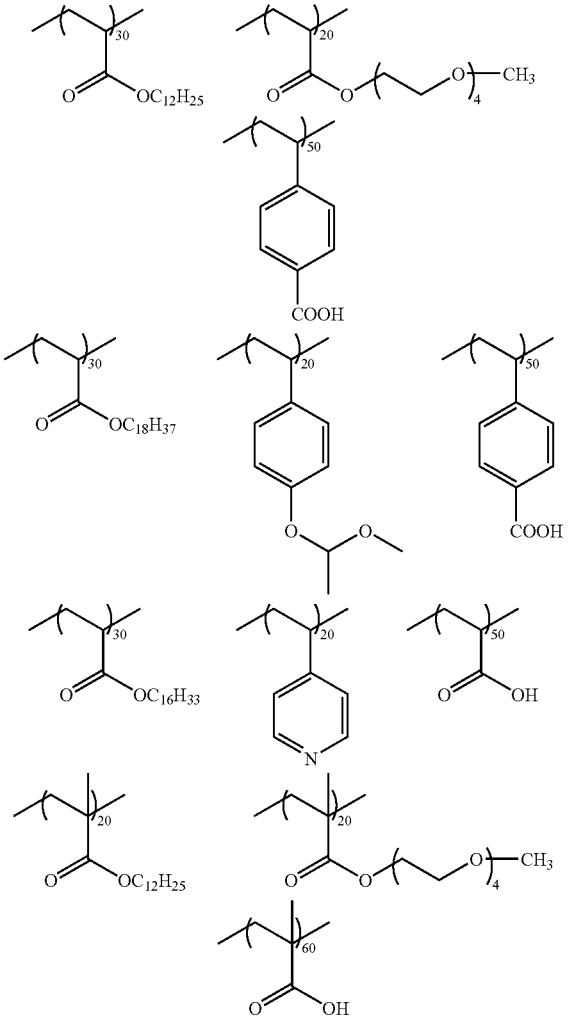

The long-chain alkyl group-containing polymer favorably used has a weight-average molecular weight of 5,000 or more and a number-averaged molecule weight of 1,000 or more. It has preferably a weight-average molecular weight of 10,000 to 5,000,000, particularly preferably 10,000 to 2,000,000, and still more preferably 20,000 to 1,000,000 as polystyrene. The long-chain alkyl group-containing polymers may be used alone or in combination of two or more.

The amount of residual monomers in the layer to which the long-chain alkyl group-containing polymer is added internally is preferably 10 mass % or less and more preferably 5 mass % or less, to avoid the problems of transfer of the planographic printing plate precursor according to the invention onto the recording layer in contact therewith during stacking and to the roller during production.

The long-chain alkyl group-containing polymer may be added internally to the organic polymer layer. The organic polymer layer is formed by preparing a coating solution containing the long-chain alkyl group-containing polymer and other components and coating and drying the solution on a substrate. In this way, the long-chain alkyl group-containing polymer and the organic polymer constituting the organic polymer layer show phase exfoliation, and the long-chain alkyl group-containing polymer sticks out of the surface as fine projections by self aggregation.

It is thus possible to adjust the surface roughness of the layer by forming the fine projections on the surface of the organic polymer.

The content of the long-chain alkyl group-containing polymer in the total solid in the organic polymer layer is preferably, approximately 0.01 to 30 mass %, more preferably, 0.1 to 20 mass %, and particularly more preferably 0.5 to 10 mass %. A content of less than 0.01 mass % or more than 30 mass % results in insufficient surface irregularity (fine projection) and also in insufficient improvement in scratch resistance.

Alternatively, fine particles of a known matting agent may be added to the layer as the means 2). The matting agent fine particle for use is not particularly limited if it is dispersible at least in the coating solution for forming the organic polymer layer. It is possible to adjust the surface roughness of the organic polymer layer easily, by adjusting the kind, particle diameter, and content of the matting agent fine particles.

Any method may be used as the means 3), if it can roughen the surface of the recording layer and the organic polymer layer. Specifically, for example, it is possible to use a method of applying a coating a solution containing materials for the organic polymer layer on a substrate and applying high-pressure on the coated surface during drying. In this way, it is possible to roughen the surface of the recording layer and the organic polymer layer after drying.

A typical example of the method of roughening the surface of organic polymer layer by applying high-pressure air is described below. The configuration of an apparatus for coating and drying favorably used in forming the organic polymer layer according to the invention is shown in FIG. 1. In the apparatus shown in FIG. 1, a surface-roughened aluminum web, for example, is used as the supporting plate, and an organic polymer layer is formed on the substrate.

The apparatus shown in FIG. 1 has a coating head 2 for coating an organic-polymer-layer-coating solution on a supporting plate, a first drying zone 3 for drying the coated solution with hot air and high-speed drying with high-pressure hot air, and a second drying zone 4 for drying it with hot air; and the first drying zone 3 has an air inlet 5 for supplying the hot air, a device 9 for generating the high-pressure air for high speed drying, a heat exchanger 10, a pressure gauge 11, a high-pressure-air blowing nozzle 12, flow rate-adjusting dampers 18 and 19, and an exhaust vent 6 for discharging the hot air. Alternatively, the second drying zone 4 has an air inlet 7 for supplying the hot air and an exhaust vent 8 for discharging the hot air. In addition, guide rolls 13 to 17 for conveying the aluminum web 1 are installed at suitable positions in the apparatus.

In the apparatus, an organic-polymer-layer coating solution is applied on the supporting plate 1 traveling at a speed of 5 to 150 m/min through the coating head 2 at a rate of 5 to 40 ml/m$^2$, and the coated supporting plate is conveyed into the first drying zone 3, where it is dried normally at a temperature of 50 to 150° C. The solvent gas vaporized is discharged together with the hot air through the exhaust vent 6. The organic-polymer-layer coated film is usually, still incompletely dried when it is dried in the area in the first drying zone 3 close to its entrance.

The undried organic-polymer-layer coated film is then dried rapidly with the high-speed air blown through the nozzle 12 placed in the direction almost perpendicular to the conveying direction of the supporting plate 1.

The high-pressure air generated in the high-pressure-air-generating device 9 such as compressor or high-pressure blower is heated to 50° C. to 150° C. in the heat exchanger 10, adjusted in its flow rate in the low rate-adjusting dampers 18 and 19, and then supplied to the high-speed blowing nozzle 12. In this way, it is possible to agitate the coated film surface and form a surface-roughened organic polymer layer (backcoat layer), by applying the high-pressure air in the shape of slit on the undried organic-polymer-layer coated film at a desirable temperature and flow rate. The pressure of the high-pressure air in nozzle 12 is normally 300 mmAq ($H_2O$) to 3 kg/cm$^2$, preferably 1,000 mmAq to 1 kg/cm$^2$. The flow rate of the blowing air from the high-speed-air-blowing nozzle 12 is approximately 20 to 300 m/s. The slid width of the high-speed blowing nozzle 12 is approximately in the range of 0.1 to 5 mm, preferably 0.3 to 1 mm. The blowing angle of the high-pressure air to the supporting plate 1 is 0° to 90°, preferably 20° to 70°. The number of nozzles used is selected in 1 to 8 according to the drying load, although only two nozzles are shown in the Figure.

Thus, drying by using high-pressure air in the first drying zone 3 gives an organic polymer layer surface-roughened to a desirable surface roughness. Then, the supporting plate carrying the organic polymer layer is conveyed into second drying zone, where it is heated by a hot air at 100° C. to 150° C. from the air-supply port 7. The solvent gas is discharged with the hot air outward through the exhaust vent 8.

Alternatively, the supporting plate may be surface-roughened for adjustment of the surface roughness of the organic polymer layer, as in means 4). The surface roughness of the supporting plate should be decided, according to the kind of the material and thickness of the organic polymer layer formed thereon. Generally, the surface roughness (arithmetic mean roughness Ra) of the rear face of supporting plate (where an organic polymer layer is formed) is preferably, approximately 0.01 to 0.60 μm and more preferably, approximately 0.15 to 0.55 μm.

The supporting plate may be surface-roughened to a desirable surface roughness, by using the surface-roughening treatment described below, while changing the condition properly.

[Recording Layer]

The recording layer for use in the planographic printing plate precursor according to the invention is a layer forming an image by irradiation of infrared ray layer, and may be a single layer or a layer in the multilayer structure. When the recoding layer is a single layer, it contains a water-insoluble and alkali-soluble resin and an infrared absorbent. Alternatively when the recording layer has a multi-layer structure, it contains a water-insoluble and alkali-soluble resin, and at least one of the layer closest to the supporting plate (hereinafter, referred to as "lower layer") and the layer farthest from the supporting plate (hereinafter, referred to as "top layer") contains an infrared absorbent.

(Water-Insoluble and Alkali-soluble Resin)

The water-insoluble and alkali-soluble resin for use in the recording layer according to the invention (hereinafter, referred to as alkali-soluble resin) is a homopolymer containing an acidic group on the main or side chain of the polymer or the copolymer or mixture thereof. Accordingly, the recording layer according to the invention has a property that it is easily dissolved in an alkaline developing solution upon contact. The alkali-soluble resin for use in the invention is not particularly limited if it is a known resin, and is preferably a polymer compound having at least one acidic group selected from (1) phenolic hydroxyl groups, (2) sulfonamide groups, (3) active imide groups, and (4) a carboxylic acid group in the molecule.

Examples thereof include, but are not-limited to, the following resins.

Examples of the polymer compounds containing phenolic hydroxyl groups (1) include novolak resins such as phenol formaldehyde resins, m-cresol formaldehyde resins, p-cresol formaldehyde resins, mixed m-/p-cresol formaldehyde resins, and mixed phenol/cresol (m-, p-, or mixed m-/p-) formaldehyde resins; and pyrogallol acetone resins.

Favorable examples of the alkali-soluble resin containing phenolic hydroxyl groups include resins prepared by condensation of a substituted phenol represented by the following Formula (i) and an aldehyde.

(i)

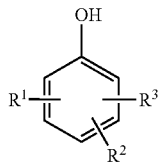

In Formula (i), $R^1$ and $R^2$ each represent a hydrogen atom, an alkyl group, or a halogen atom. The alkyl group is preferably an alkyl group having 1 to 3 carbon atoms, more preferably an alkyl group having 1 or 2 carbon atoms. The halogen atom is a fluorine, chlorine, bromine or iodine atom, preferably a chlorine or bromine atom. $R^3$ represents an alkyl or cycloalkyl group having 3 to 6 carbon atoms.

Typical examples of the substituted phenols include isopropylphenol, t-butylphenol, t-amylphenol, hexylphenol, cyclohexylphenol, 3-methyl-4-chloro-6-tertiary-butylphenol, isopropyl cresol, t-butylcresol, and t-amylcresol. Among them, t-butylphenol and t-butylcresol are preferable.

Examples of the aldehydes used in condensation with the substituted phenol above include aliphatic and aromatic aldehydes such as formaldehyde, acetaldehyde, acrolein, and crotonaldehyde. Among them, formaldehyde and acetaldehyde is preferable.

Other examples of the phenolic hydroxyl group-containing alkali-soluble resin include polymer compounds having a phenolic hydroxyl group on the side chain. Examples of the polymer compounds having a phenolic hydroxyl group on the side chain include homopolymers of a low-molecular weight compound having one or more phenolic hydroxyl groups and one or more polymerizable unsaturated bonds, and copolymers thereof with another polymerizable monomer.

Examples of the phenolic hydroxyl group-containing polymerizable monomers include phenolic hydroxyl group-containing acrylamide, methacrylamide, and acrylic and methacrylic esters, hydroxystyrenes, and the like. Typical favorable examples thereof include N-(2-hydroxyphenyl) acrylamide, N-(3-hydroxyphenyl)acrylamide, N-(4-hydroxyphenyl)acrylamide, N-(2-hydroxyphenyl)methacrylamide, N-(3-hydroxyphenyl)methacrylamide, N-(4-hydroxyphenyl)methacrylamide, o-hydroxyphenyl acrylate, m-hydroxyphenyl acrylate, p-hydroxyphenyl acrylate, o-hydroxyphenyl methacrylate, m-hydroxyphenyl methacrylate, p-hydroxyphenyl methacrylate, o-hydroxystyrene, m-hydroxystyrene, p-hydroxystyrene, 2-(2-hydroxyphenyl)ethyl acrylate, 2-(3-hydroxyphenyl)ethyl acrylate, 2-(4-hydroxyphenyl)ethyl acrylate, 2-(2-hydroxyphenyl)ethyl methacrylate, 2-(3-hydroxyphenyl)ethyl methacrylate, 2-(4-hydroxyphenyl)ethyl methacrylate, and the like. The phenolic hydroxyl group-containing resins may be used in combination of two or more.

Examples of the phenolic hydroxyl group-containing alkali-soluble resins for use in the invention include the phenolic hydroxyl group-containing alkali-soluble resins at least part of the phenolic hydroxyl groups therein are esterified described in JP-A No. 11-288089.

Examples of the alkali-soluble resin having a sulfonamide group (2) include homopolymers of a sulfonamide group-containing polymerizable monomer and copolymers thereof with another polymerizable monomer. Examples of the sulfonamide group-containing polymerizable monomers include low-molecular weight polymerizable compounds having one or more sulfonamide groups -NH-$SO_2$- of which the nitrogen is bound to at least one hydrogen atom and one or more polymerizable unsaturated bonds in the molecule. Among them, low-molecular weight compounds having an acryloyl, allyl, or vinyloxy group and a substituted or monosubstituted aminosulfonyl group or a substituted sulfonylimino group are preferable.

Typical examples of the sulfonamide group-containing alkali-soluble resins include those described in JP-B No. 7-69605.

The alkali-soluble resin having an active imide group (3) is preferably a resin having the active imide group (—CO—NH—$SO_2$—) in the molecule, and examples of the polymer compounds include homopolymers of a low-molecular weight polymerizable monomer having one or more active imide groups and one or more polymerizable unsaturated bonds in the molecule and copolymers thereof with another polymerizable monomer compound.

Typical favorable examples of the compounds include N-(p-toluenesulfonyl)methacrylamide, N-(p-toluenesulfonyl)acrylamide, and the like.

Examples of the alkali-soluble resins having carboxylic acid group (4) include homopolymers of a low-molecular weight polymerizable monomer having one or more carboxylic acid groups and one or more polymerizable unsaturated bonds in the molecule and copolymers thereof with another polymerizable monomer. Typical examples of the carboxylic acid group-containing polymerizable monomers include α,β-unsaturated carboxylic acids such as acrylic acid, methacrylic acid, maleic acid, maleic anhydride, and itaconic acid. Other favorable examples thereof include unsaturated carboxylic acids of a monoester of the hydroxyl group in an acrylate or methacrylate having a hydroxyl group on the side chain (for example, 2-hydroxyethylethyl acrylate or methacrylate, etc.) with a dibasic acid (such as succinic acid, glutaric acid, phthalic acid, or the like).

Examples of the alkali-soluble resins according to the invention further include copolymers of two or more of the phenolic hydroxyl group-containing polymerizable monomer, the sulfonamide group-containing polymerizable monomer, the active imide group-containing polymerizable monomer, and carboxylic acid group-containing polymerizable monomer; and copolymers of two or more of the polymerizable monomers and another polymerizable monomer.

In the invention, when the alkali-soluble resin is a copolymer of monomers containing an acidic group (phenolic hydroxyl group, sulfonamide group, active imide group, or carboxylic acid group) and an other polymerizable monomer, the content of the alkali-solubilizing monomers is preferably 10 mol % or more, more preferably 20 mol % or more, from the viewpoint of alkali solubility.

Examples of the monomer components copolymerized with the acidic group-containing monomers include, but are not limited to, the following compounds (m1) to (m11):

(m1) aliphatic hydroxyl group-containing acrylic and methacrylic esters such as 2-hydroxyethyl acrylate and 2-hydroxyethyl methacrylate;

(m2) alkyl acrylates such as methyl acrylate, ethyl acrylate, propyl acrylate, butyl acrylate, amyl acrylate, hexyl acrylate, octyl acrylate, benzyl acrylate, 2-chloroethyl acrylate, and glycidyl acrylate;

(m3) alkyl methacrylates such as methyl methacrylate, ethyl methacrylate, propyl methacrylate, butyl methacrylate, amyl methacrylate, hexyl methacrylate, cyclohexyl methacrylate, benzyl methacrylate, 2-chloroethyl methacrylate, and glycidyl methacrylate;

(m4) acrylamides and methacrylamides such as acrylamide, methacrylamide, N-methylol acrylamide, N-ethylacrylamide, N-hexylmethacrylamide, N-cyclohexylacrylamide, N-hydroxyethylacrylamide, N-phenylacrylamide, N-nitrophenylacrylamide, and N-ethyl-N-phenylacrylamide;

(m5) vinyl ethers such as ethyl vinylether, 2-chloroethyl vinylether, hydroxyethyl vinylether, propyl vinylether, butyl vinylether, octyl vinylether, and phenyl vinylether;

(m6) vinyl esters such as vinyl acetate, vinyl chloroacetate, vinyl butyrate, and vinylbenzoate;

(m7) styrenes such as styrene, α-methylstyrene, methylstyrene, and chloromethylstyrene;

(m8) vinyl ketones such as methyl vinylketone, ethyl vinylketone, propyl vinylketone, and phenyl vinylketone;

(m9) olefins such as ethylene, propylene, isobutylene, butadiene, and isoprene;

(m10) N-vinylpyrrolidone, acrylonitrile, methacrylonitrile, and the like; and (m11) unsaturated imides such as maleimide, N-acryloylacrylamide, N-acetylmethacrylamide, N-propionylmethacrylamide, and N-(p-chlorobenzoyl)methacrylamide.

Any one of known methods such as graft copolymerization, block copolymerization, and random copolymerization may be used for copolymerization of the alkaline water-soluble polymer compounds.

In the invention, the alkali-soluble resin preferably has a weight-average molecular weight of 2,000 or more, more preferably a weight-average molecular weight of 5,000 to 300,000, when it is a homopolymer or copolymer of the acidic group-containing polymerizable monomers. In the invention, the alkali-soluble resin preferably has a weight-average molecular weight 500 to 50,000, more preferably 700 to 20,000, and particularly preferably 1,000 to 10,000, when it is a phenol formaldehyde resin, a cresol aldehyde resin, or the like.

When the recording layer has a multilayer structure, the alkali-soluble resin used in the top layer of recording layer is preferably a phenolic hydroxyl group-containing resin because it generates stronger hydrogen-bonding in the unexposed region and allows cleavage of part of the hydrogen bonds in the exposed region. It is more preferably a novolak resin.

Two or more alkali-soluble resins different in solubilization speed in aqueous alkaline solution may be used as mixed, and the blending ratio thereof is arbitrary. The alkali-soluble resin favorably used in the top layer of a multi-layered recording layer as it is mixed with a phenolic hydroxyl group-containing resin is preferably an acrylic resin, more preferably an acrylic resin having a sulfonamide or carboxylic acid group, because it has low compatibility with the phenolic hydroxyl group-containing resin.

When the recording layer has a multilayer structure, the alkali-soluble resin above is used in the lower layer of recording layer, which should be highly alkali-soluble particularly in nonimage region. The layer also should be resistant to the various printing chemicals used during printing and show stabilized printing durability under various printing conditions. Therefore, a resin that does not impair such properties is preferably selected. A resin superior in solubility in various alkaline developing solutions, resistance to various printing chemicals, and physical strength is preferably selected from the viewpoint above. In addition, the alkali-soluble resin used in the lower layer is preferably a resin having a smaller solvent solubility in the coating solvent for the top layer that is resistant to solubilization in the solvent when the top layer is coated. It is possible to prevent undesirable solubilization at the interface of two layers by properly selecting such a resin.

Among the alkali-soluble resins above, the alkali-soluble resin contained in the lower layer is preferably an acrylic resin from these viewpoints. In particular, an acrylic resin having a sulfonamide group is preferable.

Examples of the alkali-soluble resins used in the lower layer favorable from the viewpoint above include, in addition to the resins above, water-insoluble and alkali-soluble polyamide resins, epoxy resins, polyvinylacetal resins, styrene resins, urethane resins, and the like. Among them, urethane and polyvinylacetal resins are preferable.

The water-insoluble and alkali-soluble polyurethane resin (hereinafter, referred to as "polyurethane resin") is not particularly limited if it is insoluble in water and soluble in aqueous alkaline solutions, and among such polyurethane resins, polymers having carboxyl groups in the main chain are preferable. Typical examples thereof include polyurethane resins having the reaction product of a diisocyanate compound represented by the following Formula (ii) and at least one of the diol compounds having a carboxyl group represented by the following Formulae (iii) and (iv) as the basic skeleton.

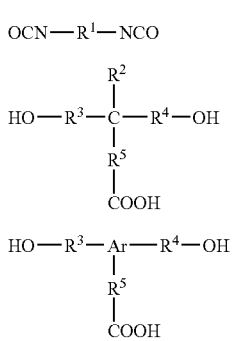

(ii)

(iii)

(iv)

In Formula (ii), $R^1$ represents a bivalent connecting group. The bivalent connecting group is, for example, an aliphatic, alicyclic or aromatic hydrocarbon, and preferably an alkylene group having 2 to 10 carbon atoms or an arylene group having 6 to 30 carbon atoms. The arylene group may be a group having two or more ring structures bound to each other via a bivalent organic connecting group such as single bond or methylene group, or a group having a fused polycyclic structure. $R^1$ may have as needed another functional group unreactive with the isocyanate group (for example, ester group, urethane group, amido group, ureido group, or the like).

$R^1$ in Formula (ii) may be substituted, and examples of the substituent groups that may be introduced include halogen atoms (—F, —Cl, —Br, and —I) and substituent groups inactive with the isocyanate group such as alkyl groups, alkoxyl groups, alkyl ester groups, and a cyano group.

Examples of the diisocyanate compounds include the compounds represented by Formula (ii) and the high-molecular weight diisocyanate compounds having isocyanate groups at both terminals of the polymer compound (oligomer or polymer) of the diol compound described below.

In Formula (iii), $R^2$ represents a hydrogen atom or an alkyl, aralkyl, aryl, alkoxy, or aryloxy group. $R^2$ may be substituted, and examples of the substituent groups that may be introduced include a cyano group, a nitro group, halogen atoms (—F; —Cl, —Br, and —I), $—CONH_2$, $—COOR^6$, $—OR^6$, $—NHCONHR^6$, $—NHCOOR^6$, $—NHCOR^6$, $—OCONHR^6$, $—CONHR^6$ (wherein, $R^6$ represents an alkyl group having 1 to 10 carbon atoms or an aralkyl group having 7 to 15 carbon atoms), and the like.

Preferably, $R^2$ is a hydrogen atom, an unsubstituted alkyl group having 1 to 8 carbon atoms, or an unsubstituted aryl group having 6 to 15 carbon atoms.

In Formulae (iii) and (iv), $R^3$, $R^4$, and $R^5$ may be the same as or different from each other and each represent a bivalent connecting group. The bivalent connecting group is, for example, an aliphatic or aromatic hydrocarbon $R^3$, $R^4$; and $R^5$ may be substituted, and examples of the substituent groups that may be introduced include alkyl groups, aralkyl groups, aryl groups, alkoxy groups, halogen atoms (—F, —Cl, —Br, and —I), and the like.

Favorable examples of the groups $R^3$, $R^4$, and $R^5$ include unsubstituted alkylene groups having 1 to 20 carbon atoms and unsubstituted arylene groups having 6 to 15 carbon atoms; still more preferable are unsubstituted alkylene groups having 1 to 8 carbon atoms. $R^3$, $R^4$, or $R^5$ may have as needed another functional group unreactive with the isocyanate group (for example, ester group, urethane group, amide group, ureide group, or ether group) in Formula (ii).

In addition, two or three of the groups $R^2$, $R^3$, $R^4$, and $R^5$ may bind to each other, forming a ring structure.

In Formula (iv), Ar represents a trivalent aromatic hydrocarbon that may be substituted, preferably an aromatic group having 6 to 15 carbon atoms.

Typical examples of the diisocyanate compounds represented by Formula (ii) include, but are not limited to, the followings:

aromatic diisocyanate compounds such as 2,4-tolylene diisocyanate, 2,4-tolylene diisocyanate dimer, 2,6-tolylene diisocyanate, p-xylylene diisocyanate, meta-xylylene diisocyanate, 4,4'-diphenylmethane diisocyanate, 1,5-naphthylene diisocyanate, and 3,3'-dimethylbiphenyl-4,4'-diisocyanate; aliphatic diisocyanate compounds such as hexamethylene diisocyanate, trimethylhexamethylene diisocyanate, lysine diisocyanate, and dimer acid diisocyanate; alicyclic diisocyanate compounds such as isophorone diisocyanate, 4,4'-methylene bis(cyclohexylisocyanate), methylcyclohexane-2,4 (or 2,6) diisocyanate, and 1,3-(isocyanatomethyl)cyclohexane; diisocyanate compounds from a diol and a diisocyanate such as the reaction product of 1 mole of 1,3-butylene glycol and 2 mole of tolylene diisocyanate; and the like.

Among them, diisocyanate having an aromatic ring such as 4,4'-diphenylmethane diisocyanate, xylylene diisocyanate, and tolylene diisocyanate are more preferably, from the viewpoint of scratch resistance.

Typical examples of the diol compound having a carboxyl group represented by Formula (iii) or (iv) include, but are not limited to, the followings:

3,5-dihydroxybenzoic acid, 2,2-bis(hydroxymethyl)propionic acid, 2,2-bis(hydroxyethyl)propionic acid, 2,2-bis(3-hydroxypropyl)propionic acid, 2,2-bis(hydroxymethyl)acetic acid, bis-(4-hydroxyphenyl)acetic acid, 4,4-bis-(4-hydroxyphenyl)pentanoic acid, tartaric acid, and the like.

Among them, 2,2-bis(hydroxymethyl)propionic acid and 2,2-bis(hydroxyethyl)propionic acid are preferable, from the viewpoint of the reactivity with isocyanate.

The polyurethane resin may be a resin prepared by using two or more of the diisocyanate compounds represented by Formula (ii) and two or more of the diol compounds having a carboxyl group represented by Formula (iii) or (iv).

In addition to the diol compounds having a carboxyl group represented by Formula (iii) or (iv), a diol compound that may be substituted that contains no carboxyl group and is thus unreactive with the isocyanate group in Formula (ii) may be used additionally to a degree that does not decrease alkali developing efficiency.

The polyurethane resin can be prepared by dissolving the diisocyanate compound and diol compound in an aprotic solvent, adding a known catalyst having an activity suitable for the reactivity of the compounds, and heating the mixture.

The molar ratio of the diisocyanate to the diol compound used is preferably 0.8:1 to 1.2:1, and the isocyanate groups, if present at the polymer terminals, are completely decomposed by treatment with an alcohol, amine, or the like.

The weight-average molecular weight of the polyurethane resin is preferably in the range of 1,000 or more, more preferably 5,000 to 100,000. These polyurethane resins may be used alone or in combination of two or more.

The water-insoluble and alkali-soluble polyvinylacetal resin will be described next. The polyvinylacetal resin used is not particularly limited if it is insoluble in water and soluble in aqueous alkaline solutions, and among the resins, the polyvinylacetal resins represented by the following Formula (v) are preferable.

Formula (v)

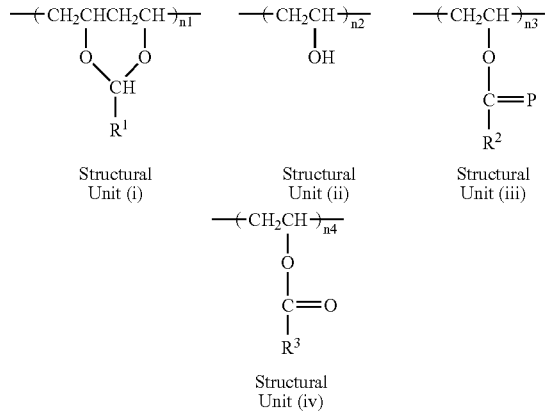

[n1 = 5~85 mol %, n2 = 0~60 mol %, n3 = 0~20 mol %, n4 = 3~60 mol %]

Among the structural units above, the polyvinylacetal resin represented by Formula (v) contains structural units (i) to (iv), specifically a vinyl acetal component of structural unit (i) and a carboxyl group-containing ester component of structural unit (iv) as essential components and a vinylalcohol component of structural unit (ii) and a unsubstituted ester component of structural unit (iii) as other additional components, and may contain at least one of each structural unit. n1to n4 each represent the component ratio (mol %) of each structural unit.

In structural unit (i), $R^1$ represents an alkyl group that may be substituted, a hydrogen atom, a carboxyl group, or a dimethylamino group. The substituent group is, for example, a carboxyl, hydroxyl, chloro, bromo, urethane, ureido, tertiary amino, alkoxy, cyano, nitro, amido, or ester group, or the like.

Typical examples of the groups $R^1$ in structural unit (i) include a hydrogen atom, methyl, ethyl, propyl, butyl, pentyl and carboxy groups, halogen atoms (—Br, —Cl, etc,.) and a cyano group-substituted methyl group, a 3-hydroxybutyl group, a 3-methoxybutyl group, a phenyl group, and the like; and among them, a hydrogen atom and propyl and phenyl groups are particularly preferable.

n1is preferably in the range of 5 to 85 mol %, more preferably in the range of 25 to 70 mol %.

n2 is preferably in the range of 0 to 60 mol %, more preferably in the range of 10 to 45 mol %.

In structural unit (iii), $R^2$ represents an unsubstituted alkyl group. An alkyl group having 1 to 10 carbon atoms is preferable, and in particular, a methyl or ethyl group is more preferable, from the viewpoint of developing efficiency.

n3 is preferably in the range of 0 to 20 mol % and more preferably in the range of 1 to 10 mol %.

In structural unit (iv), $R^3$ represents a carboxyl group-containing aliphatic, alicyclic, or aromatic hydrocarbon group; and those having 1 to 20 carbon atoms are preferable. The hydrocarbon group in structural unit (iv) above is preferably a hydrocarbon group prepared mainly in reaction of an acid anhydride such as succinic anhydride, maleic anhydride, phthalic anhydride, trimellitic anhydride, or cis-4-cyclohexene-1,2-dicarboxylic anhydride and the resudual —OH group of polyvinylacetal, and among them, a condensate with phthalic anhydride or succinic anhydride is more preferable. It may be a hydrocarbon group obtained by using another cyclic acid anhydride.

In structural unit (iv), $R^3$ may have a substituent other than a carboxyl group. Examples of the substituent groups include those represented by the following structures.

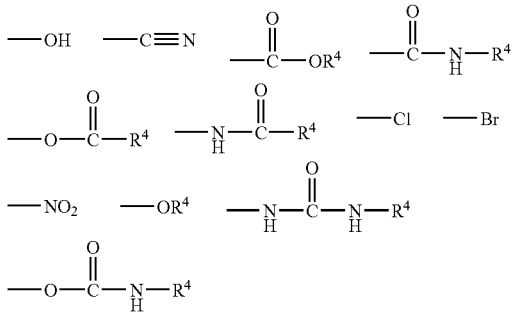

In the Formulae above, $R^4$ represents an alkyl, aralkyl, or aryl group having 1 to 20 carbon atoms that may be substituted, and the substituent group that may be introduced is —OH, —C≡N, —Cl, —Br, or —$NO_2$.

Typical examples of the group $R^3$ in structural unit (iv) include, but are not limited to, the followings:

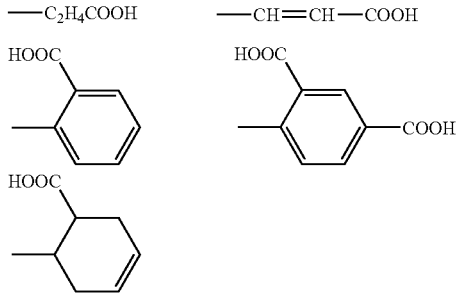

n4 is preferably in the range of 3 to 60 mol %, more preferably in the range of 10 to 55 mol %, from the viewpoint of developing efficiency.

The polyvinylacetal resin represented by Formula (v) can be prepared by forming an acetal in reaction of a polyvinylalcohol and an aldehyde and additionally allowing the residual hydroxy group to react with an acid anhydride.

Examples of the aldehydes for use include, but are not limited to, formaldehyde, acetaldehyde, propionaldehyde, butylaldehyde, pentylaldehyde, hexylaldehyde, glyoxylic acid, N,N-dimethylformamide di-n-butylacetal, bromoacetaldehyde, chloroacetaldehyde, 3-hydroxy-n-butylaldehyde, 3-methoxy-n-butylaldehyde, 3-(dimethylamino)-2,2-dimethyl propionaldehyde, cyanoacetaldehyde, and the like.

The acid content of the polyvinylacetal resin is preferably contained in the range of 0.5 to 5.0 meq/g (i.e., KOH (mg): 84 to 280) and more preferably in the range of 1.0 to 3.0 meq/g.

The molecular weight of the polyvinylacetal resin is preferably, approximately 5,000 to 400,000, more preferably approximately 20,000 to 300,000, as the weight-average molecular weight determined by gel permeation chromatography. These polyvinylacetal resins may be used alone or in combination of two or more.

The alkali-soluble resins for use in the lower layer may be used alone or in combination of two or more.

When the recording layer is single-layered, the content of the alkali-soluble resin is preferably 30 to 99 mass %, more preferably 40 to 95 mass %, with respect to the total solid in the recording layer, from the viewpoints of the sensitivity and durability of recording layer.

When the recording layer is multi-layered, the content of the alkali-soluble resin is preferably 40 to 98 mass %, more preferably 60 to 97 mass %, with respect to the total solid in the top layer, from the viewpoints of the sensitivity and durability of recording layer.

The content of the alkali-soluble resin in the lower layer is preferably 40 to 95 mass %, more preferably 50 to 90 mass % with respect to the total solid in the lower layer.

(Development Inhibitor)

The recording layer may contain a development inhibitor for improvement in its inhibition (solubilization-suppressing potential). When the recording layer has a multilayer structure, the development inhibitor is preferably contained in the top layer.

The development inhibitor is not particularly limited, if it has interaction with the alkali-soluble resin, substantially reduces the solubility of the alkali-soluble resin in the developing solution in the unexposed region, and has a weaker interaction and thus become soluble in the developing solution in the exposed region; and quaternary ammonium salts, polyethylene glycol compounds, and others are used favorably. There are some in the photo-thermal converting agents and image-coloring agents described below that function as a development inhibitor, and these compounds may also be used favorably.

The quaternary ammonium salt is not particularly limited, and examples thereof include tetraalkylammonium salts, trialkylarylammonium salts, dialkyl diarylammonium salts, alkyltriarylammonium salts, tetraarylammonium salts, cyclic ammonium salts, and bicyclic ammonium salts.

Typical examples thereof include tetrabutylammonium bromide, tetrapentylammonium bromide, tetrahexylammonium bromide, tetraoctylammonium bromide, tetralaurylammonium bromide, tetraphenylammonium bromide, tetranaphthylammonium bromide, tetrabutylammonium chloride, tetrabutylammonium iodide, tetrastearylammonium bromide, lauryltrimethylammonium bromide, stearyltrimethylammonium bromide, behenyltrimethylammonium bromide, lauryltriethylammonium bromide, phenyltrimethylammonium bromide, 3-trifluoromethylphenyltrimethylammonium bromide, benzyltrimethylammonium bromide, dibenzyldimethylammonium bromide, distearyldimethylammonium bromide, tristearylmethylammonium bromide, benzyltriethylammonium bromide, hydroxyphenyltrimethylammonium bromide, N-methylpyridinium bromide, and the like. In particular, the quaternary ammonium salts described in JP-A Nos. 2003-167332 and 2003-107688 are preferable.

From the viewpoints of development inhibition efficiency and easiness in coating the alkali-soluble resin, the amount of the quaternary ammonium salt added is preferably 0.1 to 50 mass %, more preferably 1 to 30 mass %, with respect to the total solid matters in the recording layer when a single-layered recording layer is used. Alternatively when a multi-layered recording layer is used, it is preferably 0.1 to 50 mass %, more preferably 1 to 30 mass %, with respect to the total solid matters in the top layer.

The polyethylene glycol compound is not particularly limited, and examples thereof include compounds having a structure presented the following Formula (vi).

$$R^{61}—(—O—(R^{63}—O—)_m—R^{62})_n \qquad \text{Formula (vi)}$$

In Formula (vi), $R^{61}$ represents a polyvalent alcohol or phenol residue; and $R^{62}$ represents a hydrogen atom or an alkyl, alkenyl, alkynyl, alkyloyl, aryl or aryloyl group having 1 to 25 carbon atoms that may be substituted. $R^{63}$ represents an alkylene residue that may be substituted; m is an average of 10 or more; and n is an integer of 1 or more and 4 or less.

Examples of the polyethylene glycol compounds represented by Formula (vi) include polyethylene glycols, polypropylene glycols, polyethylene glycol alkylethers, polypropylene glycol alkylethers, polyethylene glycol arylethers, polypropylene glycol arylethers, polyethylene glycol alkylarylethers, polypropylene glycol alkylarylethers, polyethylene glycol glycerol esters, polypropylene glycol glycerol esters, polyethylene sorbitol esters, polypropylene glycol sorbitol esters, polyethylene glycol fatty acid esters, polypropylene glycol fatty acid esters, polyethylene glycol-modified ethylenediamines, polypropylene glycol-modified ethylenediamines, polyethylene glycol-modified diethylenetriamines, and polypropylene glycol-modified diethylenetriamines.

Typical examples thereof include polyethylene glycol 1000, polyethylene glycol 2000, polyethylene glycol 4000, polyethylene glycol 1 0000, polyethylene glycol 20000, polyethylene glycol 5000, polyethylene glycol 100000, polyethylene glycol 200000, polyethylene glycol 500000, polypropylene glycol 1500, polypropylene glycol 3000, polypropylene glycol 4000, polyethylene glycol methylether, polyethylene glycol ethylether, polyethylene glycol phenylether, polyethylene glycol dimethylether, polyethylene glycol diethylether, polyethylene glycol diphenylether, polyethylene glycol laurylether, polyethylene glycol dilaurylether, polyethylene glycol nonylether, polyethylene glycol cetylether, polyethylene glycol stearylether, polyethylene glycol distearylether, polyethylene glycol behenylether, polyethylene glycol dibehenylether, polypropylene glycol methylether, polypropylene glycol ethylether, polypropylene glycol phenylether, polypropylene glycol dimethylether, polypropylene glycol diethylether, polypropylene glycol diphenylether, polypropylene glycol laurylether, polypropylene glycol dilaurylether, polypropylene glycol nonylether, polyethylene glycol acetyl ester, polyethylene glycol diacetyl ester, polyethylene glycol benzoate ester, polyethylene glycol laurate ester, polyethylene glycol dilaurate ester, polyethylene glycol nonyl acid ester, polyethylene glycol cetyl acid ester, polyethylene glycol stearoyl ester, polyethylene glycol distearoyl ester, polyethylene glycol behenic acid ester, polyethylene glycol dibehenic acid ester, polypropylene glycol acetyl ester, polypropylene glycol diacetyl ester, polypropylene glycol benzoate ester, polypropylene glycol dibenzoate ester, polypropylene glycol laurate ester, polypropylene glycol dilaurate ester, polypropylene glycol nonyl acid ester, polyethylene glycol glycerol ether, polypropylene glycol glycerol ether, polyethylene glycol sorbitol ether, polypropylene glycol sorbitol ether, polyethylene glycol-modified ethylenediamines, polypropylene glycol-modified ethylenediamines, polyethylene glycol-modified diethylenetriamines, polypropylene glycol-modified diethylenetriamines, and polyethylene glycol-modified pentamethylene hexamines.

From the viewpoints of development inhibition efficiency and image-forming property, the amount of the polyethylene glycol compound added is preferably 0.1 to 50 mass %, more preferably, 1 to 30 mass %, with respect to the total solid matters in the recording layer, when a single-layered recording layer is used. When a multi-layered recording layer is used it is preferably 0.1 to 50 mass %, more preferably I to 30 mass %, with respect to the total solid matters in the top layer.

Although such a measure to improve the inhibition (solubilization-suppressing potential) often leads to deterioration in sensitivity, addition of the lactone compound described in JP-A No. 2002-361066 to the top layer is effective in avoiding the deterioration in sensitivity.

Combined use of a thermal-decomposable substance, such as onium salt, o-quinonediazide compound, aromatic sulfone compound, or aromatic sulfonic ester compound, that substantially decreases the solubility of the alkali-soluble resin when it is not decomposed, with the compound above as solubilization inhibitor is preferable, for improvement of the inhibition of the developing solution in the image region.

Examples of the onium salts for use in the invention include diazonium salts, ammonium salts, phosphonium salts, iodonium salts, sulfonium salts, selenonium salts, arsenium salts, and the like; examples of particularly favorable onium salts include the diazonium salts described in S. I. Schlesinger, Photogr. Sci. Eng., 18,387 (1974), T. S. Bal et al., Polymer, 21, 423 (1980), and JP-A No. 5-158230; the ammonium salts described in U.S. Pat. Nos. 4,069,055 and 4,069,056 and JP-A No. 3-140140; the phosphonium salts described in D. C. Necker et al., Macromolecules, 17, 2468 (1984), C. S. Wen et al., Teh, Proc. Conf. Rad. Curing ASIA, p. 478 Tokyo, Oct (1988), and U.S. Pat. Nos. 4,069,055 and 4,069,056; the iodonium salts described in J. V. Crivello et al., Macromolecules, 10(6), 1307 (1977), Chem. & Eng. News, Nov. 28, p. 31 (1988), EP Patent No. 104,143, U.S. Pat. Nos. 5,041,358 and 4,491,628, and JP-A Nos. 2-150848 and 2-296514; the sulfonium salts described in J. V. Crivello et al., Polymer J. 17, 73 (1985), J. V. Crivello et al., J. Org. Chem., 43, 3055 (1978), W. R. Watt et al., J. Polymer Sci., Polymer Chem. Ed., 22, 1789 (1984), J. V. Crivello et al, Polymer Bull., 14, 279 (1985), J. V. Crivello et al., Macromolecules, 14(5), 1141 (1981), J. V. Crivello et al., J. Polymer Sci., Polymer Chem. Ed., 17, 2877 (1979), EP Patent Nos. 370,693, 233,567, 297,443, and 297,442, U.S. Pat. Nos. 4,933,377, 3,902,114, 4,491,628, 4,760,013, 4,734,444, and 2,833,827, and Germany Patent Nos. 2,904, 626, 3,604,580, and 3,604,581; the selenonium salts described in J. V. Crivello et al., Macromolecules, 10(6), 1307 (1977), and J. V. Crivello et al., J. Polymer Sci, Polymer Chem. Ed., 17, 1047 (1979); the arsonium salts described in C. S. Wen et al., Teh, Proc. Conf. Rad. Curing ASIA, p. 478 Tokyo, Oct (1988); and the like.

Among the onium salts above, diazonium salts are particularly preferable. Particularly favorable diazonium salts are those described in JP-A No. 5-158230.

Examples of the counter ions for the onium salt include anions of tetrafluoroboric acid, hexafluorophosphoric acid, triisopropylnaphthalenesulfonic acid, 5-nitro-o-toluenesulfonic acid, 5-sulfosalicylic acid, 2;5-dimethylbenzenesulfonic acid, 2,4,6-trimethylbenzenesulfonic acid, 2-nitrobenzenesulfonic acid, 3-chlorobenzenesulfonic acid, 3-bromobenzenesulfonic acid, 2-fluorocaprylnaphthalenesulfonic acid, dodecylbenzenesulfonic acid, 1-naphthol-5-sulfonic acid, 2-methoxy-4-hydroxy-5-benzoyl-benzenesulfonic acid, p-toluenesulfonic acid, and the like.

Among them, anions of hexafluorophosphoric acid and an alkyl aromatic sulfonic acid such as triisopropylnaphthalenesulfonic acid or 2,5-dimethylbenzenesulfonic acid are favorable.

Favorable quinonediazides include o-quinonediazide compounds. The o-quinonediazide compound for use in the invention is a compound containing at least one o-quinonediazide group that increases its alkali-solubility by thermal decomposition; and compounds in various structures may be used. The o-quinonediazide accelerates solubilization of the top layer, while losing its function as a development inhibitor and converting itself into an alkali-soluble substance by thermal decomposition.

Examples of the o-quinonediazide compounds include the compounds described in J. Corsair, "Light Sensitive Systems"(John Wiley & Sons Inc.) p. 339 to 352, and o-quinonediazidesulfonic esters and amides, which are prepared in reaction with an aromatic polyhydroxy compound or an aromatic amino compound, are particularly favorable. The esters of benzoquinone-(1,2)-diazidesulfonyl chloride or naphthoquinone-(1,2)-diazide-5-sulfonyl chloride and a pyrogallol-acetone resin described in JP-B No. 43-28403 and the esters of benzoquinone-(1,2)-diazidesulfonyl chloride or naphthoquinone-(1,2)-diazide-5-sulfonyl chloride and a phenol-formaldehyde resin described in U.S. Pat. Nos. 3,046,120 and 3,188,210 are also used favorably.

In addition, esters of naphthoquinone-(1,2)-diazide-4-sulfonyl chloride and a phenol formaldehyde resin or a cresol-formaldehyde resin and esters of naphthoquinone-(1,2)-diazide-4-sulfonyl chloride and a pyrogallol-acetone resin are also used favorably. Other useful o-quinonediazide compounds are disclosed in many patents, for example, in JP-A Nos. 47-5303, 48-63802, 48-63803, 48-96575, 49-38701, and 48-13354; JP-B Nos. 41-11222, 45-9610, and 49-17481; U.S. Pat. Nos. 2,797,213, 3,454,400, 3,544,323, 3,573,917, 3,674,495, and 3,785,825; British Patent Nos. 1,227,602, 1,251,345, 1,267,005, 1,329,888, and 1,330,932; German Patent No. 854,890; and others.

When a single-layered recording layer is used, the amount of the o-quinonediazide compound added is preferably in the range of 1 to 50 mass %, more preferably 5 to 30 mass % with respect to the total solid matters in the recording layer. When a multi-layered recording layer is used, it is preferably in the range of 1 to 50 mass %, more preferably 5 to 30 mass %, and particularly preferably 10 to 30 mass %, with respect to the total solid matters in the top layer. These compounds may be used alone or in combination of two or more.

The polymers of the (meth)acrylate monomer having two or more perfluoroalkyl groups and having 3 to 20 carbon atoms in the molecule described in JP-A No. 2000-187318 are preferably used additionally, for the purpose of strengthening the inhibition of recording layer surface and improving the surface resistance to scratching.

When a single-layered recording layer is used, the addition amount is preferably 0.1 to 10 mass %, more preferably 0.5 to 5 mass %, with respect to the total solid matters in the recording layer. When a multi-layered recording layer is used, it is preferably 0.1 to 10 mass %, more preferably 0.5 to 5 mass %, with respect to the total solid matters in the top layer.

(Infrared Absorbent)

The recording layer according to the invention contains an infrared absorbent.

Addition of an infrared absorbent having the absorption maximum in the infrared region and a photo-thermal converting potential makes it possible to record an image on the planographic printing plate precursor according to the invention by irradiation of infrared laser.

The infrared absorbent for use in the invention is not particularly limited, if it is a dye absorbing infrared or near-infrared light and generating heat, and any one of known infrared absorbents may be used.

When the recording layer according to the invention has a multilayer structure, at least one of the layer closest to the supporting plate (lower layer) and the layer farthest from the supporting plate (top layer) is a layer containing the infrared absorbent, and it is preferable to add an infrared absorbent both to the lower and top layers.

Examples of the infrared absorbents for use include commercially available dyes and the dyes described in literatures (e.g., "Dye Handbook" Soc. Synthetic Organic Chemistry Ed., 1970). Typical examples thereof include azo dyes, metal complex salt azo dyes, pyrazolone azo dyes, anthraquinone dyes, phthalocyanine dyes, carbonium dyes, quinonimine dyes, methine dyes, cyanine dyes, and the like. Among these dyes, those absorbing infrared or near-infrared light are particularly preferable in the invention, because they are more compatible with lasers emitting infrared or near-infrared light.

Favorable examples of the dyes include the cyanine dyes described in JP-A Nos. 58-125246, 59-84356, and 60-78787 and U.S. Pat. No. 4,973,572; the methine dyes described in JP-A Nos. 58-173696, 58-181690, and 58-194595; the naphthoquinone dyes described in JP-A Nos. 58-112793, 58-224793, 59-48187, 59-73996, 60-52940, and 60-63744; the squalilium dyes described in JP-A No. 58-112792; the cyanine dyes described in British Patent 434,875; and the like.

Other favorable examples of the dyes include the infrared-absorbing sensitizers described in U.S. Pat. No. 5,156,938, and particularly favorable examples thereof include the substituted arylbenzo(thio)pyrylium salts described in U.S. Pat. No. 3,881,924; the trimethinethiapyrylium salts described in JP-A No. 57-142645 (U.S. Pat. No. 4,327,169); the pyrylium compounds described in JP-A Nos. 58-181051, 58-220143, 59-41363, 59-84248, 59-84249, 59-146063, and 59-146061; the cyanine dyes described in JP-A No. 59-216146; the pentamethinethiopyrylium salts described in U.S. Pat. No. 4,283,475; the pyrylium compounds described in JP-B No. 5-13514 and 5-19702; and the like; as well as commercial products such as EpolightIII-178, EpolightIII-130, and EpolightIII-125 manufactured by Epolin Inc.

Other particularly favorable examples thereof include the infrared-absorbing dyes represented by Formulae (I) and (II) described in U.S. Pat. No. 4,756,993.

Among these dyes, particularly preferable are cyanine dyes, squalilium dyes, pyrylium salts, nickel thiolate complexes, and indolenine cyanine dyes. Cyanine dyes and indolenine cyanine dye are further more preferably, and examples of the particularly preferable dyes include cyanine dyes represented by the following Formula (a).

Formula (a)

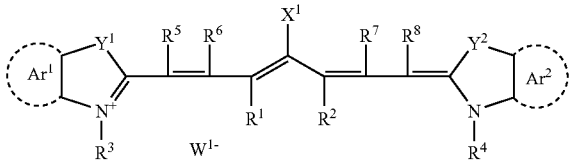

In Formula (a), $X^1$ represents a hydrogen or halogen atom, —$NPh_2$, $X^2$-$L^1$ or a group shown below. $X^2$ represents an oxygen, nitrogen, or sulfur atom; and $L^1$ represents a hydrocarbon group having 1 to 12 carbon atoms, a hetero atom-containing aromatic ring, a hetero atom-containing hydrocarbon group having 1 to 12 carbon atoms. The hetero atom is N, S, O, a halogen atom, or Se. $Xa^-$ is the same as $W^{1-}$ described below; and $R^a$ represents a hydrogen atom or a substituent group selected from alkyl, aryl, and substituted or unsubstituted amino groups, and halogen atoms.

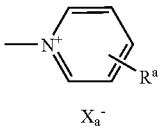

In Formula (a), $R^1$ and $R^2$ each independently represent a hydrocarbon group having 1 to 12 carbon atoms. $R^1$ and $R^2$ each preferably represent a hydrocarbon group having two or more carbon atoms, and $R^1$ and $R^2$ particularly preferably bind to each other, forming a 5- or 6-membered ring, from the point of the storage stability of the recording layer coating solution.

$Ar^1$ and $Ar^2$ each independently represent an aromatic hydrocarbon group that may be substituted. Favorable aromatic hydrocarbon groups include benzene and naphthalene rings. Favorable substituent groups include hydrocarbon groups having 12 or fewer carbon atoms, halogen atoms, and alkoxy groups having 12 or fewer carbon atoms. $Y^1$ and $Y^2$ each independently represent a sulfur atom or a dialkylmethylene group having 12 or fewer carbon atoms. $R^3$ and $R^4$ each independently represent a hydrocarbon group having 20 or fewer carbon atoms that may have one or more substituents. Favorable substituent groups include alkoxy groups having 12 or fewer carbon atoms, a carboxyl group, and a sulfo group. $R^5$, $R^6$, $R^7$ and $R^8$ each independently represent a hydrogen atom or a hydrocarbon group having 12 or fewer carbon atoms. It is preferably a hydrogen atom, from the availability of raw material. $W^{1-}$ represents a counter anion. However, when the cyanine dye represented by Formula (a) has an anionic substituent group in its structure, there is no need for neutralization of electric charge, and thus, no $W^{1-}$ is needed. $W^{1-}$ is preferably a halide, perchlorate, tetrafluoroborate, hexafluorophosphate, or sulfonate ion, particularly preferably, a perchlorate, hexafluorophosphate, or arylsulfonate ion, form the point of the storage stability of the recording-layer coating solution.

When a multi-layered recording layer is used, the infrared absorbent is preferably added to the top layer of recording layer or the layer close to it, form the viewpoint of sensitivity. It is possible to make the layer more sensitive and the unexposed region more alkali-resistant, particularly by adding a dye having solubilization-suppressing potential such as cyanine dye together with an alkali-soluble resin having a phenol group to the layer. These infrared absorbents may be added to the lower layer or the top layer, or alternatively to both top and lower layers. It is possible to raise the sensitivity further, by adding it to the lower layer. When infrared absorbents are added both to the top and lower layers, they may be the same as or different from each other.

Alternatively, the infrared absorbent may be added to a layer formed separately from the recording layer. When an additional layer is used, the layer added with the absorbent is preferably close to the recording layer.

The amount of the infrared absorbent added is preferably 3 to 50 mass %, more preferably, 5 to 40 mass %, with respect to the total solid matters in the recording layer, when a single-layered recording layer is used. When the recording layer is a multi-layered recording layer, the amount of the infrared absorbent added to the top layer is preferably 0.01 to 50 mass %, more preferably 0.1 to 30 mass %, and particularly preferably 1.0 to 30 mass %, with respect to the total solid matters in the top layer. It is possible to obtain a recording layer favorable in sensitivity and durability, by adjusting the addition amount in the range above. Alternatively when added to the lower layer, the infrared absorbent is added in an amount of preferably 0 to 20 mass %, more preferably 0 to 10 mass %, and particularly preferably 0 to 5 mass %, with respect to the total solid matters in the lower layer.

When the infrared absorbent is added to the lower layer, use of an infrared absorbent having solubilization-suppressing potential leads to deterioration in the solubility of the lower layer, but also to possible improvement in the solubility of the lower layer due to the heat generated by the infrared absorbent during infrared laser irradiation, and thus, the compounds added and the addition amounts thereof should be selected, considering the balance thereof. It is difficult to obtain improvement in solubility in the region close to the supporting plate separated by 0.2 to 0.3 μm because of diffusion of the heat generated by irradiation, and thus, addition of an infrared absorbent to the lower layer may lead to deterioration in solubility and also in sensitivity. For that reason, an addition amount that decreases the solubilization speed of the lower layer in developing solution (25 to 30° C.) to 30 nm/sec is not favorable, even if it is in the range above.

(Other Additives)

In forming the recording layer, various additives may be added as needed in addition to the components above in the ranges that do not impair the advantageous effects of the invention.

When a multi-layered recording layer is used, the additives below may be added only to the lower or top layer of recording layer or both to the top and lower layers.

<Development Accelerator>

An acid anhydride, phenol or organic acid may be added to the recording layer for improvement in sensitivity.

The acid anhydride is preferably a cyclic acid anhydride, and typical examples thereof include phthalic anhydride, tetrahydrophthalic anhydride, hexahydrophthalic anhydride, 3,6-endoxy-tetrahydrophthalic anhydride, tetrachlorophthalic anhydride, maleic anhydride, chloromaleic anhydride, a-phenylmaleic anhydride, succinic anhydride, pyromellitic anhydride and the like, as described in U.S. Pat. No. 4,115,128. Favorable examples of non-cyclic acid anhydrides include acetic anhydride and the like.

Examples of the phenols include bisphenol A, 2,2'-bishydroxydiphenylsulfone, 4,4'-bishydroxydiphenylsulfone, p-nitrophenol, p-ethoxyphenol, 2,4,4'-trihydroxybenzophenone, 2,3,4-trihydroxybenzophenone, 4-hydroxybenzophenone, 4,4',4"- trihydroxytriphenylmethane, 4,4',3",4"-tetrahydroxy-3,5,3',5'-tetramethyltriphenylmethane, and the like.

Examples of the organic acids include the sulfonates, sulfinates, alkyl sulfates, phosphonic acids, phosphoric esters and carboxylic acids described in JP-A Nos. 60-88942 and 2-96755; and typical examples thereof include p-toluenesulfonic acid, dodecylbenzenesulfonic acid, p-toluenesulfinic acid, ethylsulfuric acid, phenylphosphonic acid, phenylphosphinic acid, phenyl phosphate, diphenyl phosphate, benzoic acid, isophthalic acid, adipic acid, p-toluyl acid, 3,4-dimethoxybenzoic acid, phthalic acid, terephthalic acid, 4-cyclohexene-1,2-dicarboxylic acid, erucic acid, lauric acid, n-undecanoic acid, ascorbic acid, and the like.

When a single-layered recording layer is used, the content of the acid anhydride, phenol or organic acid is preferably 0.05 to 20%, more preferably 0.1 to 15 mass %, and particularly preferably 0.1 to 10 mass %, with respect to the total solid in the recording layer. When a multi-layered recording layer is used, the content of the acid anhydride, phenol or and organic acid is preferably 0.05 to 20 mass %, more preferably 0.1 to 15 mass %, and particularly preferably 0.1 to 10 mass %, with respect to the total solid in the lower or top layer of recording layer.

<Surfactant>

The nonionic surfactant described in JP-A Nos. 62-251740 and 3-208514, the amphoteric surfactant described in JP-A Nos. 59-121044 and 4-13149, the siloxane compound described in EP Patent No. 950517, or the fluorine-containing copolymer described in JP-A Nos. 62-170950, 11-288093, and 2003-057820 may be added to the recording layer, for improvement in coatability and stability during processing under the development condition.

When a single-layered recording layer is used, the content of the surfactant is preferably 0.01 to 15 mass %, more preferably 0.05 to 5 mass %, and particularly preferably 0.1 to 0.5 mass %, with respect to the total solid in the recording layer rate.

When a multi-layered recording layer is used, the content of the surfactant is preferably 0.01 to 15 mass %, more preferably 0.1 to 5.0 mass %, and still more preferably 0.5 to 2.0 mass %, with respect to the total solid in the lower or top layer of recording layer.

<Baking-out Agent/colorant>

A baking-out agent or an image-coloring agent such as dye or pigment may be added to the recording layer to obtain a visible image immediately after heating by exposure.

Typical examples of the baking-out agents are combinations of a compound that generates an acid by heating induced by light exposure (photo-induced acid-releasing agent) and an organic dye that can form a salt therewith. Specific examples thereof include combination of the o-naphtoquinonediazide-4-sulfone halide described in JP-A Nos. 50-36209 or 53-8128 and a salt-forming organic dye; and combination of the trihalomethyl compound described in JP-A Nos. 53-36223, 54-74728, 60-3626, 61-143748, 61-151644 or 63-58440 and a salt-forming organic dye. The trihalomethyl compounds include oxazole and triazine compounds, and both of them give a baked-out image superior in storability and definition.

In addition to the salt-forming organic dyes described above, other dyes may be used as the image-coloring agents. Favorable dyes including the salt-forming organic dyes include oil-soluble dyes and basic dyes. Typical examples thereof include Oil Yellow #101, Oil Yellow #103, Oil Pink #312, Oil Green BG Oil Blue BOS, Oil Blue #603, Oil Black BY, Oil Black BS, and Oil Black T-505 (manufactured by Orient Chemical Industries), Victoria Pure Blue, crystal violet lactone, crystal violet (CI42555), methyl violet (CI42535), ethyl violet, rhodamine B (CI145170B), malachite green (CI42000), methylene blue (CI52015), and the like. The dyes described in JP-A No. 62-293247 are particularly preferable.

When a single-layered recording layer is used, the dye is preferably added in an amount of preferably 0.01 to 10 mass %, preferably 0.1 to 3 mass %, with respect to the total solid matters in the recording layer.

When a multi-layered recording layer is used, the dye is added in an amount of 0.01 to 10 mass %, preferably 0.1 to 3 mass %, with respect to the total solid matters in the lower or top layer of recording layer.

<Plasticizer>

A plasticizer may be added to the recording layer for improvement in the flexibility of the coated film.

Examples thereof include butylphthalyl, polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate, acrylic or methacrylic acid oligomers and polymers, and the like.

When a single-layered recording layer is used, the plasticizer is added at a rate of 0.5 to 10 mass %, preferably 1.0 to 5.0 mass %, with respect to the total solid matters in the recording layer.

When the recording layer has a multilayer structure, it is added at a rate of 0.5 to 10 mass %, preferably 1.0 to 5.0 mass %, with respect to the total solid matters in the lower or top layer of recording layer.

<Wax>

A compound lowering the static friction coefficient of the surface may be added to to the top layer of the single- or multi-layered recording layer according to the invention for improvement in resistance to scratch. Typical examples thereof include the compounds having a long-chain alkylcarboxylic ester described in U.S. Pat. No. 6,117,913 and Japanese Patent Application Nos. 2001-261627, 2002-032904, and 2002-165584 filed by the applicant, and the like.

When a single-layered recording layer is used, the addition amount thereof is preferably 0.1 to 10 mass %, preferably 0.5 to 5.0 mass %, with respect to the total solid matters in the recording layer.

When the recording layer has a multilayer structure, the rate thereof in the top layer of recording layer is preferably 0.1 to 10 mass % and more preferably 0.5 to 5 mass %.

[Formation of Recording Layer]

The recording layer of the planographic printing plate precursor according to the invention is formed by dissolving the components constituting the recording layer in a solvent and coating the solution.

Examples of the solvents for use include, but are not limited to, ethylene dichloride, cyclohexanone, methylethylketone, methanol, ethanol, propanol, ethylene glycol monomethylether, 1-methoxy-2-propanol, 2-methoxyethyl acetate, 1-methoxy-2-propyl acetate, dimethoxyethane, methyl lactate, ethyl lactate, N,N-dimethylacetamide, N,N-dimethylformamide, tetramethylurea, N-methylpyrrolidone, dimethylsulfoxide, sulfolane, γ-butylolactone, toluene, and the like. These solvents are used alone or in combination of two or more.

When a multi-layered recording layer is used, the lower and top layers of recording layer are in principle formed in two separate layers.

Examples of the methods of forming the two separate layers include a method of using the difference in solvent solubility of the components contained in the top and lower layers, a method of coating the top layer, then drying it rapidly and thus removing the solvent, and the like.

Details of these methods are described in JP-A No. 2002-251003.

It is also possible to make the top and lower layers partially compatible with each other to the order that is favorable for obtaining the advantageous effects of the invention and for providing the recoding layer with a new function. In such a case, it is possible to make the layers partially compatible with each other, for example, by controlling the difference in solvent solubility, or by controlling the vaporization speed of the solvent in the top layer coated.

The concentration of the components (total solid including additives) excluding solvents in the recording-layer coating solution to be coated on the substrate is preferably 1 to 50 mass %.

Various coating methods including, for example, bar coater coating, spin coating, spray coating, curtain coating, immersion, air knife coating, blade coating, roll coating, and the like, may be used for coating.

In the case of a multi-layered recording layer, the top layer is favorably coated by a non-contact method, for prevention of damage to the lower layer during application. Alternatively, a bar coater coating method, a commonly used method for solution-based coating although it is a contact-type method, may be used, and, if used, the top layer is preferably coated while the bar coater is driven in the normal rotation, for prevention of the damage to the lower layer.

When a single-layered recording layer is used, the coating amount of the recording layer after drying is preferably in the range of 0.3 to 3.0 g/m$^2$ and more preferably in the range of 0.5 to 2.5 g/m$^2$.

When a multi-layered recording layer is used, the coating amount of the lower layer components after drying is preferably in the range of 0.5 to 4.0 g/m$^2$ and more preferably in the range of 0.6 to 2.5 g/m$^2$. It is possible to obtain an image superior in printing durability, by making the content 0.5 g/m2 or more and an image favorable in reproducibility and sensitivity by making it 4.0 g/m$^2$ or less.

The coating amount of the top layer components after drying is preferably in the range of 0.05 to 1.0 g/m$^2$ and more preferably in the range of 0.08 to 0.7 g/m$^2$. It is possible to obtain an image favorable in development latitude and scratch resistance by making it 0.05 g/m$^2$ or more and an image favorable in sensitivity by making it 1.0 g/m$^2$ or less.

The coating amount of the lower and top layers combined after drying is preferably in the range of 0.6 to 4.0 g/m$^2$ and more preferably in the range of 0.7 to 2.5 g/m$^2$. It is possible to obtain an image favorable in printing durability by making it 0.6 g/m$^2$ or more and an image favorable in image reproducibility and sensitivity by making it 4.0 g/m$^2$ or less.

(Organic Polymer Layer)

In the invention, the supporting plate characteristically has an organic polymer layer on the face thereof opposite to the recording layer.

Hereinafter, components constituting the organic polymer layer will be described.

(Organic Polymer)

The organic polymer layer contains an organic polymer as the base polymer for the layer.

Organic polymers favorably used as the base polymers include, but are not is not limited to, the followings: at least one compound selected from novolak resins such as phenol formaldehyde resins, m-cresol formaldehyde resins, p-cresol formaldehyde resins, mixed m-/p-cresol formaldehyde resins, and mixed phenol/cresol (m-, p-, or mixed m-/p-) formaldehyde resins; pyrogallol acetone resins, saturated copolymeric polyester resins, phenoxy resins, polyvinylacetal resins and vinylidene chloride copolymer resins.

The saturated copolymeric polyester resin contains a dicarboxylic acid unit and a diol unit. Examples of the dicarboxylic acid units for the polyester for use in the invention include aromatic dicarboxylic acids such as phthalic acid, terephthalic acid, isophthalic acid, tetrabromophthalic acid, and tetrachlorophthalic acid; saturated fatty dicarboxylic acids such as adipic acid, azelaic acid, succinic acid, oxalic acid, suberic acid, sebacic acid, malonic acid, and 1,4-cyclohexanedicarboxylic acid; and the like.

Examples of the diol units include aliphatic-chain diols such as ethylene glycol, diethylene glycol, triethylene glycol, polyethylene glycol, propylene glycol, dipropylene glycol, polypropylene glycol, 1,3-butylene glycol, 2,3-butylene glycol, 1,4-butylene glycol, neopentylglycol, hexanediol, and 2,2,4-trimethyl-1,3-pentanediol; cyclic diols such as 1,4-bis-β-hydroxyethoxycyclohexane, cyclohexanedimethanol, tricyclodecanedimethanol, bisphenol dioxyethylether, and bisphenol dioxypropylether; and the like.

At least one of these dicarboxylic acid and diol units and two or more of the dicarboxylic acid or diol units are used as copolymerization units, and the properties of the copolymer is determined by the composition and the molecular weight of the copolymer.

The organic polymer layer according to the invention can be formed by thermal compression or melt lamination of film, but is preferably formed by solution coating for more efficient preparation of a thin film. Thus, when a copolymerization polyester resin is used as the organic polymer, it is preferably non-crystalline and easily soluble in various industrial organic solvents.

When a copolymerization polyester resin is used as the organic polymer, the molecular weight of the resin is preferably 10,000 or more from the point of the strength of the organic polymer layer.

Phenoxy resins, which are prepared from bisphenol A and epichlorohydrin similarly to epoxy resins, are superior in chemical resistance and adhesiveness to epoxy resins even without use of a hardening agent or a catalyst, and thus, favorable as the principal component for the backcoat.

Polyvinylacetal resins are resins of a polyvinylalcohol acetalized with an aldehyde such as butylaldehyde or formaldehyde, and polyvinylbutyral and polyvinylformal resins are used favorably. These polyvinylacetal resins are different in physical and chemical properties, depending on the acetalization degree, composition of the hydroxyl and acetyl groups, and polymerization degree; and polyvinylacetal resins having a glass transition temperature of 60° C. or higher are favorable for the organic polymer layer according to the invention.

The vinylidene chloride copolymer resins used are copolymers of a vinylidene chloride monomer and a vinyl monomer such as vinyl chloride, vinyl acetate, ethylene, or vinyl methylether or an acrylic monomer such as (meth) acrylic ester or (meth)acrylonitrile. Among them, vinylidene chloride copolymers containing acrylonitrile in an amount of 20 mol % or less are favorable, because they are easily soluble in common organic solvents.

The content of the organic polymer is preferably 99.99 to 70 mass %, more preferably 99.9 to 80 mass %, and particularly preferably, 99.5 to 90 mass %, with respect to the total solid in the organic polymer layer.

The organic polymer layer may contain another hydrophobic polymer compound as needed, in addition to the organic polymer. Favorable examples of the hydrophobic polymer compounds include polybutene, polybutadiene; polyamide, unsaturated copolymeric polyester resins, polyurethane, polyurea, polyimide, polysiloxane, polycarbonate, epoxy resins, chlorinated polyethylene, alkylphenol aldehyde condensation resins, polyvinyl chloride, polyvinylidene chloride, polystyrene, acrylic resins and the copolymers thereof, hydroxycellulose, polyvinylalcohol, cellulose acetate, carboxymethylcellulose, and the like.

Other favorable hydrophobic polymer compounds include copolymers containing the following monomer (1m) to (12m) as the structural unit and having a molecular weight normally of 10,000 to 200,000:

(1m) aromatic hydroxyl group-containing acrylamides, methacrylamides, acrylic esters, methacrylic esters and hydroxystyrenes, such as N-(4-hydroxyphenyl)acrylamide, N-(4-hydroxyphenyl)methacrylamide, o-, m- and p-hydroxystyrenes, o-, m- and p-hydroxyphenyl acrylates and methacrylates;

(2m) aliphatic hydroxyl group-containing acrylic esters and methacrylic esters such as 2-hydroxyethyl acrylate and 2-hydroxyethyl methacrylate;

(3m) unsubstituted and substituted acrylic esters such as methyl acrylate, ethyl acrylate, propyl acrylate, butyl acrylate, amyl acrylate, hexyl acrylate, cyclohexyl acrylate, octyl acrylate, phenyl acrylate, benzyl acrylate, 2-chloroethyl acrylate, 4-hydroxybutyl acrylate, glycidyl acrylate, and N-dimethylaminoethyl acrylate;

(4m) unsubstituted and substituted methacrylic esters such as methyl methacrylate, ethyl methacrylate, propyl methacrylate, butyl methacrylate, amyl methacrylate, hexyl methacrylate, cyclohexyl methacrylate, octyl methacrylate, phenyl methacrylate, benzyl methacrylate, 2-chloroethyl methacrylate, 4-hydroxybutyl methacrylate, glycidyl methacrylate, and N-dimethylaminoethyl methacrylate;

(5m) acrylamides and methacrylamides such as acrylamide, methacrylamide, N-methylol acrylamide, N-methylol methacrylamide, N-ethylacrylamide, N-ethylmethacrylamide, N-hexylacrylamide, N-hexylmethacrylamide, N-cyclohexylacrylamide, N-cyclohexylmethacrylamide, N-hydroxyethylacrylamide, N-hydroxyethylacrylamide, N-phenylacrylamide, N-phenylmethacrylamide, N-benzylacrylamide, N-benzylmethacrylamide, N-nitrophenylacrylamide, N-nitrophenylmethacrylamide, N-ethyl-N-phenylacrylamide and N-ethyl-N-phenylmethacrylamide;

(6m) vinyl ethers such as ethyl vinylether, 2-chloroethyl vinylether, hydroxyethyl vinylether, propyl vinylether, butyl vinylether, octyl vinylether, and phenyl vinylether;

(7m) vinyl esters such as vinyl acetate, vinyl chloroacetate, vinyl butyrate, and vinyl benzoate;

(8m) styrenes such as styrene, methylstyrene, and chloromethylstyrene;

(9m) vinyl ketones such as methyl vinylketone, ethyl vinylketone, propyl vinylketone, and phenyl vinylketone;

(10m) olefins such as ethylene, propylene, isobutylene, butadiene, and isoprene;

(11m) N-vinylpyrrolidone, N-vinylcarbazole, 4-vinylpyridine, acrylonitrile, and methacrylonitrile; and (12m) acrylamides such as N-(o-aminosulfonylphenyl) acrylamide, N-(m-aminosulfonylphenyl)acrylamide, N-(p-aminosulfonylphenyl)acrylamide, N-(1-(3-aminosulfonyl) naphthyl)acrylamide, and N-(2-aminosulfonylethyl) acrylamide; methacrylamides such as N-(o-aminosulfonylphenyl)methacrylamide, N-(m-aminosulfonylphenyl)methacrylamide, N-(p-aminosulfonylphenyl)methacrylamide, N-(1-(3-aminosulfonyl)naphthyl)methacrylamide, and N-(2-aminosulfonylethyl)methacrylamide; unsaturated sulfonamides of acrylic ester such as o-aminosulfonylphenyl acrylate, m-aminosulfonylphenyl acrylate, p-aminosulfonylphenyl acrylate, and 1-(3-aminosulfonylphenylnaphthyl) acrylate; and unsaturated sulfonamides of methacrylic ester such as o-aminosulfonylphenyl methacrylate, m-aminosulfonylphenyl methacrylate, p-aminosulfonylphenyl methacrylate, and 1-(3-aminosulfonylphenylnaphthyl) methacrylate.

In addition, the monomer above may be copolymerized with another copolymerizable monomer. The favorable hydrophobic polymer compounds also include, but are not limited to, the copolymers obtained by copolymerization of the monomers above and additional modification, for example, with glycidyl acrylate, glycidyl methacrylate, or the like.

The hydrophobic polymer compound may be added in an amount in the range of 50 mass % or less with respect to the total solid matters in the organic polymer layer, but is added preferably in an amount of 30 mass % or less, for making the most of the properties of the saturated copolymer favorably used as the organic polymer, such as polyester resin, phenoxy resin, polyvinylacetal resin, or vinylidene chloride copolymer resin.

(Other Components)

A plasticizer, a surfactant and other additives may be added as needed to the organic polymer layer in the range that does not impair the advantageous effects of the invention, for improvement in flexibility and coated surface and adjustment of the lubricity.

Favorable examples of the plasticizers include phthalic esters such as dimethyl phthalate, diethyl phthalate, dibutyl phthanolate, diisobutyl phthalate, dioctyl phthalate, octyl capryl phthalate, dicyclohexyl phthalate, ditridecyl phthalate, butylbenzyl phthalate, diisodecyl phthalate, and diallyl phthalate; glycol esters such as dimethylglycol phthalate, ethylphthalyl ethylglycolate, methylphthalyl ethylglycolate, butylphthalyl butylglycolate, and triethylene glycol dicaprylic ester; phosphate esters such as tricrezyl phosphate and triphenyl phosphate; aliphatic dibasic esters such as isobutyl adipate, dioctyl adipate, dimethyl sebacate, dibutyl sebacate, dioctyl azelate, and dibutyl maleate; polyglycidyl methacrylate, triethyl citrate, glycerol triacetyl ester, butyl laurate, and the like.

The amount of the plasticizer added to the organic polymer layer varies according to the kind of the organic polymer used for the organic polymer layer, and is preferably added in an amount in the range that does not decrease the glass transition temperature of the polymer layer to 60° C. or lower.

The surfactants include anionic, cationic, nonionic and amphoteric surfactants. Typical examples thereof include nonionic surfactants such as polyoxyethylene alkylethers, polyoxyethylene alkylphenylethers, polyoxyethylene polystyrylphenylethers, polyoxyethylene polyoxypropylene alkylethers, glycerols partially esterified with a fatty acid, sorbitans partially esterified with a fatty acid, pentaerythritols partially esterified with a fatty acid, propylene glycol monofatty acid esters, sucroses partially esterified with a fatty acid, polyoxyethylene sorbitans partially esterified with a fatty acid, polyoxyethylene sorbitols partially esterified with a fatty acid, polyethylene glycol fatty acid esters, polyglycerins partially esterified with a fatty acid, polyoxyethylene-modified castor oils, polyoxyethylene glycerols partially esterified with a fatty acid, fatty acid diethanol amides, N,N-bis-2-hydroxyalkylamines, polyoxyethylene alkylamine, triethanolamine fatty acid esters, and trialkylamine oxides; anionic surfactants such as fatty acid salts, abietate salts, hydroxyalkanesulfonate salts, alkanesulfonate salts, dialkyl sulfosuccinate ester salts, straight-chain alkylbenzenesulfonate salts, branching-chain alkylbenzenesulfonate salts, alkylnaphthalenesulfonate salts, alkylphenoxypolyoxyethylenepropyl sulfonate salts, polyoxyethylenealkylsulfophenylether salts, N-methyl-N-oleyltaurine sodium salt, N-alkyl-sulfoscuccinic monoamide disodium salts, petroleum sulfonate salts, sulfated beef tallow oil, sulfate ester salts of a fatty acid alkyl ester, alkylsulfate ester salts, polyoxyethylene alkylether sulfate ester salts, fatty acid monoglyceride sulfate ester salts, polyoxyethylene alkylphenylether sulfate ester salts, polyoxyethylene styrylphenylether sulfate ester salts, alkylphosphate ester salts, polyoxyethylene alkylether phosphate ester salts, polyoxyethylene alkylphenylether phosphate ester salts, partial hydrolysates of styrene/maleic anhydride copolymers, partial hydrolysates of olefin/maleic anhydride copolymers, and formalin condensates of naphthalenesulfonate salts; cationic surfactants such as alkylamine salts, quaternary ammonium salts, polyoxyethylene alkylamine salts, and polyethylene polyamine derivatives; amphoteric surfactants such as carboxybetaines, aminocarboxylic acids, sulfobetaines, aminosulfate esters, and imidazolines; and the like. In the surfactants above, the polyoxyethylene in the polyoxyethylene-based surfactants may be replaced with a polyoxyalkylene such as polyoxymethylene, polyoxypropylene, or polyoxybutylene, and those surfactants are also included in the examples.

Still more preferable surfactants are fluorochemical surfactants containing a perfluoroalkyl group in the molecule. Examples of the fluorochemical surfactants include anionic surfactants such as perfluoroalkylcarboxylate salts, perfluoroalkylsulfonate salts, and perfluoroalkylphosphate esters; ampholytic surfactants such as perfluoroalkylbetaines; cationic surfactants such as perfluoroalkyltrimethylammonium salt; and nonionic surfactants such as perfluoroalkylamine oxides, perfluoroalkylethyleneoxide adducts, oligomers containing perfluoroalkyl and hydrophilic groups, oligomers containing perfluoroalkyl and oleophilic groups, oligomers containing perfluoroalkyl, hydrophilic and oleophilic groups, and urethanes containing perfluoroalkyl and oleophilic groups; and the like.

The surfactants may be used alone or in combination of two or more, in an amount of preferably in the range of 0.001 to 10 mass %, more preferably 0.01 to 5 mass % in the organic polymer layer.

The organic polymer layer may contain additionally other additives including dye for coloring, silane-coupling agent for improvement in adhesion to aluminum supporting plate, diazonium salt-containing diazo resin, organic phosphonic acid, organic phosphoric acid, cationic polymer, and lubricant such as common wax, higher fatty acid, higher fatty acid amide, dimethylsiloxane-based silicone compound, modified dimethylsiloxane, or polyethylene powder.

The thickness of the organic polymer layer is arbitrary, if it is a thickness resistant to scratching on the recording layer without use of insert paper, and is normally in the range of 0.05 to 50 μm, more preferably 0.5 to 25 μm, and still more preferably 1.0 to 20 μm. When the thickness is in the range above, it is possible to prevent scratching or the like on the recording layer effectively, even when the planographic printing plate precursors are handled as stacked.

(Formation of Organic Polymer Layer)

The organic polymer layer according to the invention is formed by preparing a coating solution by dissolving the components for the organic polymer layer and coating the coating solution on the face of the substrate opposite to the recording layer (rear face).

The organic solvents described in JP-A No. 62-251739 may be used alone or in combination as the solvent. Examples of the solvents include, but are not limited to, ethylene dichloride, cyclohexanone, methylethylketone, methanol, ethanol, propanol, ethylene glycol monomethylether, 1-methoxy-2-propanol, 2-methoxyethyl acetate, 1-methoxy-2-propyl acetate, dimethoxyethane, methyl lactate, ethyl lactate, N,N-dimethylacetamide, N,N-dimethylformamide, tetramethylurea, N-methylpyrrolidone, dimethylsulfoxide, sulfolane, β-butylolactone, toluene, and the like. These solvents may be used alone or as a mixture.

(Properties of Organic Polymer Layer)

The organic polymer layer preferably has a dynamic friction coefficient of the organic polymer layer surface in the range of 0.20 to 0.70, for maximizing the advantageous effects of the invention.

The dynamic friction coefficient is a value determined according to standard ASTM D1894, the disclosure of which is incorporated by reference herein, by bringing the organic polymer layer surface in contact with the surface of the recording layer formed on the face of supporting plate opposite to the organic polymer layer.

As described above, the infrared-sensitive planographic printing plate precursor according to the invention, which has an arithmetic mean roughness Ra of the organic polymer layer in the range of 0.05 to 0.40 μm, is resistant to adhesion at the interface between the recording layer and the organic polymer layer and scratching even when stresses such as vibration are applied.

As a result, even when the infrared-sensitive planographic printing plate precursors according to the invention are stacked without insert paper, it is possible to obtain the advantageous effects of eliminating the scratching and the adhesion troubles of the recording layer in the production, processing and platemaking steps or during conveyance for packaging and transportation as product.

Thus, for example, there is no scratching generated on the recording layer due to the friction between the recording layer and the organic polymer layer in contact with each other by vibration during transportation, even when the planographic printing plate precursors are packaged and transported as they are stacked. It is also possible to prevent generation of scratches on the recording layer, even if a region of the recording and backcoat layers of the plate material is pressed tightly to each other, for example, when the infrared-sensitive planographic printing plate precursors according to the invention are supplied into an exposure device equipped with an auto-loader.

[Supporting Plate]

The supporting plate for use in the planographic printing plate precursor according to the invention is not particularly limited, if it is a dimensionally stable plate-shaped material having needed strength and durability, and examples thereof include paper, papers laminated with a plastic film (such as of polyethylene, polypropylene, or polystyrene), metal plates (such as of aluminum, zinc, and copper), plastic films (such as of cellulose diacetate, cellulose triacetate, cellulose propionate, cellulose butyrate, cellulose acetate butyrate, cellulose nitrate, polyethylene terephthalate, polyethylene, polystyrene, polypropylene, polycarbonate, and polyvinylacetal), papers and plastic films laminated or vapor-deposited with the metal above, and the like.

Among them, the supporting plate for use in the invention is preferably a polyester film or an aluminum plate, and particularly preferable an aluminum plate, as it is superior in dimensional stability and relatively cheap. Favorable aluminum plates are pure aluminum plates and alloy plates containing aluminum as the main component and small amounts of foreign elements, or may be plastic films laminated or deposited with aluminum. The foreign elements in the aluminum alloys include silicon, iron, manganese, copper, magnesium, chromium, zinc, bismuth, nickel, and titanium. The content of the foreign elements in the alloy is 10 wt % at the maximum.

Although the most preferable aluminum in the invention is pure aluminum, the aluminum plate may contain a small amount of foreign elements, as it is difficult to prepare completely pure aluminum due to the problems in refining process.

As described above, the aluminum plates to be used in the invention are not particularly specified, and any one of the aluminum plates known and used in the art may be used arbitrarily. The thickness of the aluminum plate for use in the invention is approximately 0.1 mm to 0.6 mm, preferably 0.15 mm to 0.4 mm, and particularly preferably 0.2 mm to 0.3 mm.

The aluminum plate may be surface-treated as needed, for example, by surface-roughening treatment, anodizing treatment, or the like. Hereinafter, the surface treatments will be described briefly.

If desired, the surface of the aluminum plate is subjected, before surface roughening, to degreasing treatment for removing the rolling oils on the surface thereof with a surfactant, organic solvent, aqueous alkaline solution, or the like. Various methods may be used for surface roughening of aluminum plates, and examples thereof include methods of scratching mechanically, dissolving the surface electrochemically, and dissolving selectively the surface chemically. The mechanical methods include various methods known in the art such as ball milling, brush milling, blast milling, and buff milling. The electrochemical surface roughening may be conducted, for example, in an electrolyte containing hydrochloric acid or nitric acid by applying alternate or direct current. Alternatively, the combined mechanical and electrochemical method described in JP-A No. 54-63902 may also be sued.

The aluminum plate surface-roughened in this manner may be etched in an alkaline solution and neutralized and then subjected to an anodizing treatment if desired for improvement in the water holding property and abrasion resistance of the surface. Any one of various electrolytes that can form porous oxide layer may be used as the electrolyte for use in the anodizing treatment of the aluminum plates, and such an electrolyte is generally sulfuric acid, phosphoric acid, oxalic acid, chromic acid, or the mixture thereof. The concentration of the electrolyte is decided according to the kind of the electrolyte.

The conditions for the anodic oxidation vary according to the electrolytes used and are not particularly specified, but are generally suitable if the concentration of the electrolytes is 1 to 80 wt %; the liquid temperature, 5 to 70° C.; the electric current density, 5 to 60 A/dm$^2$; the voltage, 1 to 100 V; and the electrolysis period, 10 seconds to 5 minutes. The anodized layer formed in an amount of less than 1.0 g/m$^2$ often results in insufficient printing durability, makes the nonimage region of planographic printing plate more susceptible to damages, and consequently, causes the problems of "scratch staining", i.e., adhesion of ink to the damaged region during printing.

After the anodizing treatment, the aluminum surface is hydrophilized as needed.

Examples of the hydrophilizing treatment used in the invention include the treatments with an alkali metal silicate (e.g., aqueous sodium silicate solution) disclosed in U.S. Pat. Nos. 2,714,066, 3,181,461, 3,280,734 and 3,902,734.

By this method, the supporting plate is immersed or electrolyzed in an aqueous sodium silicate solution. Alternatively, the supporting plate may be subjected to the methods of treating it with potassium fluorozirconate disclosed in JP-B No.36-22063 and of treating it with polyvinylphosphonic acid disclosed in U.S. Pat. Nos. 3,276,868, 4,153,461, and 4,589,272.

(Organic Undercoat Layer)

An organic undercoat layer may be formed as needed between the supporting plate and the recording layer of the planographic printing plate precursor according to the invention.

Components for the organic undercoat layer include various organic compounds, and examples thereof include carboxymethylcellulose, dextrin, gum arabic, amino group-containing phosphonic acids such as 2-aminoethylphosphonic acid, phenylphosphonic acids that may be substituted, naphthylphosphonic acid, alkylphosphonic acids, glycerophosphonic acid, and organic phosphonic acids such as methylenediphosphonic acid and ethylenediphosphonic acid, phenylphosphoric acid that may be substituted, organic phosphoric acids such as naphthylphosphoric acid, glycerophosphoric acid and alkylphosphoric acid, phenylphosphinic acids that may be substituted, organic phosphinic acids such as naphthylphosphinic acid, glycerophosphinic acid and alkylphosphinic acid, amino acids such as glycine and β-alanine, and hydrochloride salts of a hydroxy group-containing amine such as triethanolamine hydrochloride salts; and these compounds my be used as a mixture of two or more.

The organic undercoat layer preferably contains an onium group-containing compound. The onium group-containing compounds are described in detail, for example, in JP-A Nos. 2000-10292, 2000-108538, and 2000-241962.

Preferable among them are the compounds selected from the group consisting of polymer compounds having a structural unit represented, for example, by poly(p-vinylbenzoic acid) in the molecule. Typical examples thereof include copolymers of p-vinylbenzoic acid and vinylbenzyltriethylammonium chloride, copolymers of p-vinylbenzoic acid and a vinylbenzyltrimethylammonium salt, and the like.

The organic undercoat layer is formed, for example, by the following methods of: preparing a solution by dissolving the organic compound in water, an organic solvent such as methanol, ethanol or methylethylketone, or a mixed solvent thereof and applying and drying the solution on an aluminum plate; and preparing a solution by dissolving the organic compound in water, an organic solvent such as methanol, ethanol or methylethylketone, or a mixed solvent thereof, immersing an aluminum plate in the solution and thus allowing the compound to be adsorbed, washing the plate, for example, with water, and drying the plate. In the former method, it is possible to apply a solution at an organic compound concentration of 0.005 to 10 mass % by various methods. In the latter method, the solution concentration is 0.01 to 20 mass %, preferably 0.05 to 5 mass %; the immersion temperature is 20 to 90° C., preferably 25 to 50° C.; and the immersion period is 0.1 second to 20 minute, preferably 2 second to 1 minute. The solution used may be adjusted with a basic substance such as ammonia, triethylamine or potassium hydroxide, or an acidic substance such as hydrochloric acid or phosphoric acid into the pH range of 1 to 12. In addition, a yellow dye may be added for improvement in the printing reproducibility of the recording layer.

The amount of the organic undercoat layer coated is preferably 2 to 200 mg/$M^2$ and more preferably 5 to 100 mg/$m^2$. It is possible to obtain sufficient printing durability when the coating amount is in the range above.

The infrared-sensitive planographic printing plate thus prepared is then exposed to an image-shaped light and then developed.

[Platemaking]

An image is formed on the planographic printing plate precursor according to the invention by heat. Specific platemaking methods include direct image recording for example by thermal recording head, scanning exposure to infrared laser, high-illumination flash irradiation for example by xenon discharge lamp, infrared lamp irradiation, and the like; and exposure to a semiconductor laser emitting an infrared light having a wavelength of 700 to 1,200 nm or a high-output infrared solid laser such as YAG laser is favorable.

The planographic printing plate precursor according to the invention after light exposure is developed and post-processed, for example, with a finisher or a protective gum, before giving a printing plate. Any one of known processing machines such as automatic developing machine may be used for these treatments.

Any one of known processing agents may be used, as it is selected, as the processing agent for use in development and posttreatment of the planographic printing plate precursor according to the invention.

The developing solution is favorably a developing solution at a pH in the range of 9.0 to 14.0, preferably 12.0 to 13.5. Any one of known aqueous alkaline solutions may be used as the developing solution. Among the aqueous alkaline solutions above, particularly favorable developing solutions include commonly-used aqueous solutions at a pH of 12 or more containing an alkali silicate or a mixture of bases and an silicon compound, so-called "silicate developing solutions", and the solutions containing no alkali silicate but containing a non-reducing sugar (organic compound having a buffering action) and a base described in JP-A Nos. 8-305039 and 11-109637 and others, so-called "non-silicate developing solutions".

The developing solution preferably contains an anionic surfactant and/or an amphoteric surfactant, for acceleration of development and prevention of scum generation.

When the planographic printing plate according to the invention is burnt, it is preferably done according to the method known in the art of using a baking conditioner and a burning processor.

The planographic printing plate after such treatments is then supplied to an offset printing machine, in which it is used for printing on numerous papers.

The planographic printing plate precursor according to the invention in such a configuration is superior in handling efficiency, because the damage of the recording layer is prevented effectively even when they are stacked without insert paper.

In another embodiment of the invention, the infrared-sensitive planographic printing plate precursor according to the invention comprises a supporting plate, a recording layer containing a water-insoluble and alkali-soluble resin and an infrared absorbent and forming an image by irradiation of infrared ray formed on one face of the supporting plate, and an anodic oxide film having a basis weight of 0.05 to 3.0 g/$m^2$ and an organic polymer layer formed in that order on the face of the supporting plate opposite to the recording layer.

Hereinafter, components for the planographic printing plate precursor in the embodiment will be described respectively in detail.

[Anodic Oxide Film]

An anodic oxide film having a basis weight in the range of 0.05 to 3.0 g/$m^2$ is formed on the face of the supporting plate opposite to the recording layer in the invention. The basis weight of the anodic oxide film is preferably in the range of 0.10 to 2.5 g/$m^2$ and particularly preferably in the range of 0.15 to 2.0 g/$m^2$.

A basis weight of anodic oxide film of less than 0.05 g/$m^2$ may lead to insufficient adhesion between the supporting plate and the organic polymer layer. Alternatively, a basis weight of more than 3.0 g/$m^2$ demands a greater amount of power during production, leading to decrease in productivity.

An anodic oxide film is often formed on the recording layer-sided surface of the supporting plate in conventional planographic printing plate precursors. The basis weight of anodic oxide film formed on the face of the supporting plate opposite to the recording layer then is normally 0 g/$m^2$, i.e., no anodic oxide film is formed thereon, but an anodic oxide film having a basis weight of 0.05 g/$m^2$ is occasionally formed in the region approximately within 5 to 20 cm from the edge of the face of the supporting-plate opposite to the recording layer, depending on the processing condition.

However, the anodic oxide film in such a degree is not effective in improving the adhesiveness to the organic polymer layer, and does not show the advantageous effects of the invention.

The basis weight of the anodic oxide film can be determined by using a fluorescent X-ray analyzer.

The condition of anodizing treatment is properly modified, for obtaining an anodic oxide film in the range above.

The processing condition for the anodic oxidation is not particularly limited, as it varies according to the electrolyte used; but generally, the electrolyte concentration is preferably in the range of 1 to 80 mass %; the liquid temperature, 5 to 70° C.; the electric current density, 5 to 60 A/dm$^2$; the voltage, 1 to 100 V; and the electrolysis period, 10 seconds to 5 minutes.

In another favorable embodiment of the planographic printing plate precursor according to the invention, an anodic oxide film is formed also on the recording layer-sided face of the supporting plate. Thus, in preparation of the planographic printing plate precursor according to the invention, it is preferable to form anodic oxide films previously on both faces of the supporting plate, each of which has a thickness (basis weight) suitable for the face.

The face of the supporting plate where the organic polymer layer is formed may be processed, similarly to the recording layer-sided surface. The surface is preferably processed after completion of the processing of the rear face, for reducing adverse influence on the recording layer-formed face.

[Organic Polymer Layer]

The planographic printing plate according to the invention characteristically has an organic polymer layer formed on the anodic oxide film described above.

Components for the organic polymer layer are the same as those described in the embodiments above.

The infrared-sensitive planographic printing plate precursor according to the invention, if it has an organic polymer layer bonded to the supporting plate by the anodic oxide film described above, does not cause exfoliation of the organic polymer layer, even when they are stacked without use of insert paper and a stress is applied thereto by mutual friction between the plate materials. As a result, even when the infrared-sensitive planographic printing plate precursors according to the invention are stacked without insert paper, it is possible to obtained the advantageous effects of eliminating scratching on the recording layer and the adhesion troubles in the production, processing and platemaking steps or during conveyance for packaging and transportation as product.

As will be described in detail, the recording layer of the planographic printing plate precursor for use in the invention contains, as principal components, an acid group-containing alkali-soluble resin and an infrared absorbent used as a solubilization inhibitor providing the resin with resistance to alkaline developing solution. Although the recording layer has relatively smaller strength and is usually vulnerable to the influence of humidity, even when the planographic printing plate precursors according to the invention having such a recording layer are transported as they are stacked and packaged, there is no damage (scratch) generated on recording layer due to the friction between the recording layer and the organic polymer layer in contact with each other caused by vibration during transportation.

In addition, there is no adhesion between the recording layer and the organic polymer layer or exfoliation of the recording layer thereby, even when the stacked plate materials are stored in a high-temperature, high-humidity environment for an extended period of time or under load.

[Supporting Plate]

In yet another embodiment of the surface-roughened aluminum plate according to the invention, an anodic oxide film is formed, as needed, at least on the face of the supporting plate opposite to the recording layer, after alkaline-etching and neutralization treatments.

An anodizing treatment is preferably performed also on the recording layer-sided face of the supporting plate, for improvement of the water holding property and abrasion resistance of the surface.

An anodizing treatment performed on the recording layer-sided face of the supporting plate will be described below. Various electrolytes that can form a porous oxide film may be used as the electrolytes for use in the anodizing treatment of the aluminum plate, and sulfuric acid, phosphoric acid, oxalic acid, chromic acid, or the mixture thereof is commonly used. The concentration of the electrolyte is determined properly according to the kind of the electrolyte used.

The processing condition of the anodic oxidation is not particularly specified, as it varies according to the electrolyte used; but generally, the concentration of the electrolyte is preferably in the range of 1 to 80 mass % solution; the liquid temperature, 5 to 70° C.; the electric current density, 5 to 60 A/dm$^2$; the voltage, 1 to 100 V; and the electrolysis period, 10 seconds to 5 minutes.

When the basis weight of the anodic oxide film on the recording layer-sided face of the supporting plate prepared by the anodizing treatment above is less than 1.0 g/m$^2$, it may result in insufficient printing durability, easier scratching in the nonimage region of the planographic printing plate, and thus, so-called "scratch staining", deposition of ink on the damaged region, during printing.

The upper limit value of the basis weight of the anodic oxide film is preferably 5.0 g/m$^2$, from the viewpoint of productivity.

EXAMPLES

Hereinafter, the invention will be described in detail with reference to Examples, but it should be understood that the invention is not restricted thereby.

Examples 1 to 10 and Comparative Examples 1 and 2

[Preparation of Supporting Plates A to D]

<Aluminum Plate>

Molten aluminum was prepared by using an aluminum alloy in a composition (consisting of Al, Si: 0.06 mass %, Fe: 0.30 mass %, Cu: 0.026 mass %, Mn: 0.001 mass %, Mg: 0.001 mass %, Zn: 0.001 mass %, Ti: 0.02 mass %, and unavoidable impurities); and the molten aluminum was filtered and molded into ingots having a thickness of 500 mm and a width of 1,200 mm by DC casting. The surface of the ingot was scraped to an average depth of 10 mm by a surface grinder, and the ingot was heated consistently at 550° C. for approximately 5 hours, and hot-rolled into a rolled plate having a thickness of 2.7 mm after it is cooled to a temperature of 400° C. The plate was heat-treated additionally at 500° C. in a continuous annealing machine, and cold-rolled into a JIS 1050 aluminum plate having a thickness of 0.24 mm. The width and the length of the average crystal grain in the aluminum plate obtained were respectively 50 μm and 300 μm. After the aluminum plate was cut to a width of 1,030 mm, it was subjected to the following surface treatment.

<Surface Treatment>

The following various treatments (a) to (k) were performed continuously. The processing solution remaining on the aluminum plate was removed by nip roller, after each treatment and washing with water.

(a) Mechanical surface-roughening treatment

The aluminum plate was surface-roughened mechanically with a revolving roller-shaped nylon brush, while an abrasion slurry suspension of an abrasive having a specific gravity of 1.12 (pumice) in water is supplied to the surface of the aluminum plate. The average diameter of the abrasive particles was 30 μm, and the maximum diameter 100 μm. The nylon brush is made of 6-10 nylon, and the length and the diameter of the bristles were respectively 45 mm and 0.3 mm. The nylon brush was planted on a ø300 mm stainless steel tube as it is embedded in the holes therein. Three rotating brushes were used. The distance between the two supporting rollers (ø200 mm) at the bottom of the brush was 300 mm. The brush roller was pressed hard onto the aluminum plate, until the load of the drive motor rotating the brush reaches 7 kW or larger than the load before the roller is pressed thereon. The rotation direction of the brush was the same as the traveling direction of the aluminum plate. The rotation frequency of the brush was 200 rpm.

(b) Alkaline etching treatment

The aluminum plate thus obtained was etched by spraying it with an aqueous solution containing caustic soda and aluminum ion at concentrations respectively of 2.6 mass % and 6.5 mass % at a temperature of 70° C. and dissolving the aluminum plate in an amount of 10 g/m$^2$. The aluminum plate was then washed with water by spraying.

(c) De-smutting treatment

The aluminum plate was de-smutted by spraying it with an aqueous solution at a temperature of 30° C. containing nitric acid at a concentration of I mass % (also containing aluminum ion at 0.5 mass %) and then washed with water by spraying. The aqueous nitric acid solution used in de-smutting used was the wastewater discharged from the step of electrochemical surface-roughening treatment in an aqueous nitric acid solution by using AC current.

(d) Electrochemical surface-roughening treatment

The aluminum plate was then surface-roughened electrochemically, continuously by applying a 60-Hz AC voltage. The electrolyte solution used then was an aqueous solution containing 10.5 g/L nitric acid (also containing aluminum ion at 5 g/L and ammonium ion at 0.007 mass %), and the liquid temperature was 50° C. The electrochemical surface-roughening treatment was performed by using a trapezoidal alternate current at an electric-current transition period from zero to the peak TP of 0.8 msec and a duty ratio of 1:1, and also using a carbon electrode as the counter electrode. The auxiliary anode used was ferrite. The electrolytic bath used was that in the radial cell type.

The electric current density was 30 A/dm$^2$ at the maximum, and when an aluminum plate is used as the anode, the total amount of electric current applied was 220 C/dm$^2$. Part (5%) of the current from power source was divided and sent to the auxiliary electrode. Subsequently, the aluminum plate was washed with water by spraying.

(e) Alkaline Etching Treatment

The aluminum plate was etched by spraying it with an aqueous solution containing caustic soda and aluminum ion at concentrations respectively of 26 mass % and 6.5 mass % at 32° C. and dissolving the aluminum plate in an amount of 0.50 g/m$^2$; and the smuts mainly of aluminum hydroxide generated in the electrochemical surface-roughening treatment was removed and the edge region of the pit was dissolved, smoothening the edge region, by using the AC current in the stage above. Subsequently, the aluminum plate was washed with water by spraying.

(f) De-smutting treatment

The aluminum plate was de-smutted by spraying it with an aqueous 15 mass % nitric acid solution (also containing aluminum ion at 4.5 mass %) at a temperature of 30° C., and then, washed with water by spraying. The aqueous nitric acid solution used in the de-smutting treatment was the wastewater from the step of electrochemical surface-roughening treatment in an aqueous nitric acid solution by using AC current.

(g) Electrochemical surface-roughening treatment

The aluminum plate was surface-roughened electrochemically, continuously by using a 60-Hz AC voltage. The electrolyte solution used then was an aqueous 5.0 g/L hydrochloric acid solution (also containing aluminum ion at 5 g/L) at a temperature of 35° C. The electrochemical surface-roughening treatment was performed by using a trapezoidal alternate current at an electric-current transition period of from zero to the peak TP of 0.8 msec and a duty ratio of 1:1 and also using a carbon electrode as the counter electrode. The auxiliary anode used was ferrite. The electrolytic bath used was that in the radial cell type.

The electric current density was 25 A/dm$^2$ at the maximum, and when an aluminum plate is used as the anode, the total amount of electric current applied was 50 C/dm$^2$. Subsequently, the aluminum plate was washed with water by spraying.

(h) Alkaline etching treatment

The aluminum plate was etched by spraying it with an aqueous solution containing caustic soda and aluminum ion at concentrations respectively of 26 mass % and 6.5 mass % at 32° C. and dissolving the aluminum plate in an amount of 0.10 g/m$^2$; and the smuts mainly of aluminum hydroxide generated in the electrochemical surface-roughening treatment was removed and the edge region of the pit was dissolved, smoothening the edge region, by using the AC current in the stage above. Subsequently, the aluminum plate was washed with water by spraying.

(i) De-smutting treatment

The aluminum plate was de-smutted by spraying it with an aqueous 25 mass % surfuric acid solution (also containing aluminum ion at 0.5 mass %) at a temperature of 60° C., and then, washed with water by spraying.

(j) Anodizing Treatment

The aluminum plate was anodized in an anodic oxidation apparatus by the two-stage power-supply electrolysis method (the length of the first and second electrolysis units: 6 m, the length of the first and second power supply units: 3 m, and the length of the first and second power-supply electrode unit: 2.4 m). The electrolyte solution supplied to the first and second electrolysis units was sulfuric acid. The electrolyte solution was an aqueous 50 g/L sulfuric acid solution (also containing aluminum ion at 0.5 mass %) at a temperature of 20° C. The aluminum plate was then washed with water by spraying. The final amount of the oxide layer thus prepared was 2.7 g/m$^2$.

(k) Alkali Metal Silicate Salt Treatment

The aluminum supporting plate obtained after the anodizing treatment was immersed in an aqueous 1 mass % No.3 sodium silicate solution at a temperature of 30° C. placed in a processing tank for 10 seconds, for alkali metal silicate salt treatment (silicate treatment). Then, the aluminum plate was washed with well water by spraying, to give a supporting plate for infrared-sensitive planographic printing plate that was hydrophilized with silicate on the surface thereof.

It was designated as a supporting plate A.

Supporting plate B: a supporting plate for infrared-sensitive planographic printing plate wherein the rear face of the aluminum plate (where an organic polymer layer is to be formed) is processed in the treatments (b) to (d) and the surface of the aluminum plate (where a recording layer is to be formed) in the treatments (a) to (k).

Supporting plate C: a supporting plate for infrared-sensitive planographic printing plate wherein the rear face of the aluminum plate (where an organic polymer layer is to be formed) is processed in the treatments (a) to (d) and the surface of the aluminum plate (where a recording layer is to be formed) in the treatments (a) to (k).

Supporting plate D: a supporting plate for infrared-sensitive planographic printing plate prepared in a similar manner to supporting plate C, except that the pressing load on the rear face of the aluminum plate (where an organic polymer layer is to be formed) in the treatment (a) in the preparative step for the supporting plate C was changed to 12 kW.

[Formation of Backcoat Layer (Organic Polymer Layer)]

An organic polymer layer was formed on the face of the supporting plate opposite to the recording layer (rear face), by preparing a backcoat solution in the following composition, coating it on each of the supporting plates A to D thus prepared while varying the coating amount by controlling the wet amount thereof, i.e., by adjusting the groove depth of the coater, and then, drying the coated film in an oven at 150° C. for 30 seconds. The amounts of the films formed after drying are summarized in the following Table 1. A matting agent was added only in Examples 4 and 9.

Backcoat Solution

| | |
|---|---|
| Organic polymer (compound shown in Table 1) | 25 g |
| Surfactant (fluorochemical surfactant B, having the following structure) | 0.05 g |
| Solvent (compound shown in Table 1) | 100 g |
| Matting agent (long-chain alkyl group-containing polymer A in the following structure) | 2.0 g |

Fluorochemical surfactant B

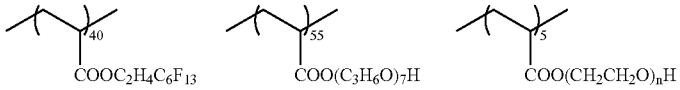

Long-chain alkyl group-containing polymer A

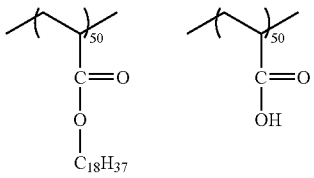

(Mw: 72,000)

In Example 5, the backcoat solution described above coated on aluminum plate was dried not in the oven but in the continuous coating drier shown in FIG. 1.

In Examples 1 and 10, after the organic polymer layer above is formed, a matt layer is formed on the surface of the organic polymer layer by the following method.

An aqueous solution in the following composition containing a resin at a solid matter concentration of 20 mass % was applied on the organic polymer layer surface by using an electrostatic air sprayer and dried at 60° C. for 5 seconds.

Resin-Containing Aqueous Solution

| | |
|---|---|
| Methyl methacrylate | 68 mass % |
| Ethyl acrylate | 20 mass % |
| Sodium acrylate | 12 mass % |

<Formation of Organic Undercoat Layer>

The following organic undercoat solution was coated on the face of the supporting plate opposite to the organic polymer layer with a bar coater and dried at 80° C. for 15 seconds, to form an organic undercoat layer having a basis weight of 18 mg/M2 after drying.

Organic Undercoat Solution

| | |
|---|---|
| Following polymer compound | 0.3 g |
| Methanol | 100 g |

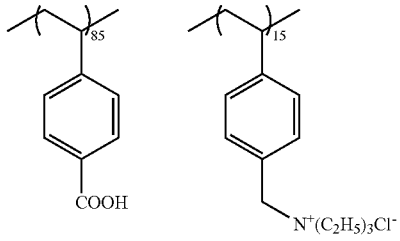

Mw: 28,000

[Formation of Recording Layer (Multi-layered)]

The following coating solution for undercoat layer I was coated on an aluminum substrate having an organic undercoat layer formed, with a bar coater, to a coating amount of 0.85 g/m$^2$ after drying, dried at 160° C. for 44 seconds, and immediately cooled to a supporting plate temperature of 35° C. by blowing a cold air at 17 to 20° C., forming a lower layer. Then, the following coating solution for upper layer 2 was then coated with a bar coater to a coating amount of 0.22 g/m$^2$ after drying, dried at 148° C. for 25 seconds, and additionally, cooled gradually by blowing a cold air at 20 to 26° C., forming an upper layer.

<Coating Solution for Undercoat Layer 1>

| | |
|---|---|
| Specified acetal polymer (in the following structure) (a/b/c/d: 36/37/2/25, weight-average molecular weight: 16,000, $R^1$: n-butyl group, $R^2$: 4-hydroxybenzyl group) | 2.80 g |
| Novolak resin (2,3-xylenol/m-cresol/p-cresol ratio: 10/20/70, weight-average molecular weight: 3,300) | 0.192 g |
| Cyanine dye A (in the following structure) | 0.134 g |
| 4,4'-Bishydroxyphenylsulfone | 0.126 g |
| Tetrahydrophthalic anhydride | 0.190 g |
| p-Toluenesulfonic acid | 0.008 g |
| 3-Methoxy-4-diazodiphenrylamine hexafluorophosphate | 0.032 g |
| Ethyl violet having 6-hydroxynaphthalenesulfonate as counter ion | 0.0781 g |
| Polymer 1 (in the following structure) | 0.035 g |
| Methylethylketone | 25.41 g |
| 1-Methoxy-2-propanol | 12.97 g |
| γ-Butylolactone | 13.18 g |

Specified acetal polymer

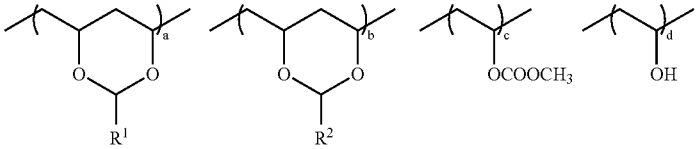

Cyanine dye A

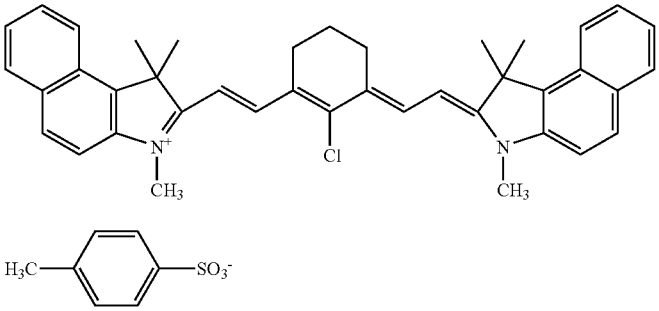

Polymer 1

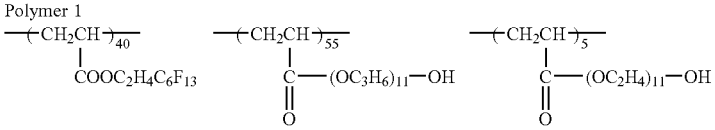

<Coating Solution for Upper Layer 2>

| | |
|---|---|
| m,p-Cresol novolak (m/p ratio: 6/4, weight-average molecular weight: 4500, containing unreacted cresol at 0.8 mass %) | 0.3479 g |
| Polymer 3 (in the following structure, 30% MEK solution) | 0.1403 g |
| Cyanine dye A (in the structure above) | 0.0192 g |
| Polymer 1 (in the structure above) | 0.015 g |
| Polymer 2 (in the following structure) | 0.00328 g |
| Quaternary ammonium salt (in the following structure) | 0.0043 g |
| Surfactant (GO-4, manufactured by Nikko Chemicals Co., Ltd., polyoxyethylene sorbit fatty acid ester, HLB: 8.5) | 0.008 g |

-continued

| | |
|---|---|
| Methylethylketone | 6.79 g |
| 1-Methoxy-2-propanol | 13.07 g |

Polymer 2

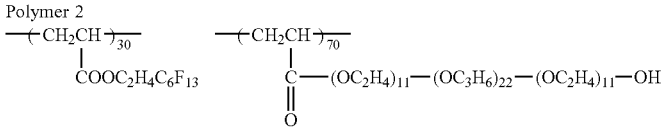

Polymer 3

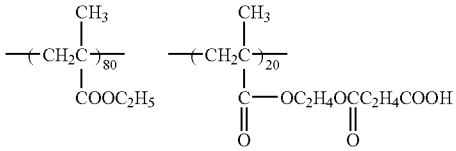

Mw 70,000

Quaternary ammonium salt

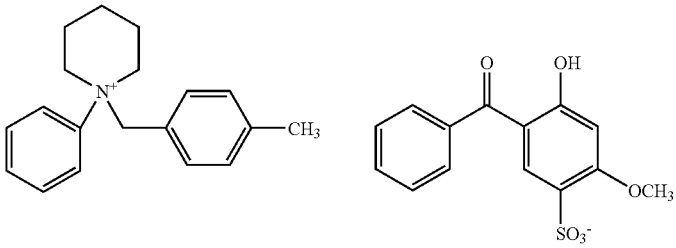

TABLE 1

| | Supporting plate | Organic polymer | Solvent | Matting agent | Coating amount of organic polymer layer ($g/m^2$) | Arithmetic mean roughness Ra (μm) |
|---|---|---|---|---|---|---|
| Example 1 | Supporting plate A | Polystyrene | Methylethylketone | — | 5 | 0.18 |
| Example 2 | Supporting plate B | Polystyrene | Methylethylketone | — | 10 | 0.22 |
| Example 3 | Supporting plate C | Polystyrene | Methylethylketone | — | 3 | 0.38 |
| Example 4 | Supporting plate A | Polystyrene | Methylethylketone | Long-chain alkyl group-containing polymer A | 12 | 0.25 |
| Example 5 | Supporting plate A | Polystyrene | Methylethylketone | — | 8 | 0.41 |
| Example 6 | Supporting plate A | Polyethylene terephthalate | 1,1,1,3,3,3-Hexafluoro-2-propanol | — | 7 | 0.15 |
| Example 7 | Supporting plate B | Saturated polyester resin (Chemit K-288) | Methylethylketone | — | 5 | 0.22 |
| Example 8 | Supporting plate C | Epoxy resin (Epikote 1001) | Methylethylketone | — | 5 | 0.35 |
| Example 9 | Supporting plate A | Vinylidene chloride-acrylonitrile copolymer resin (Saran F-310) | Methylethylketone | Long-chain alkyl group-containing polymer A | 5 | 0.17 |
| Example 10 | Supporting plate A | Polyvinylbutyral resin (Denka Butyral K-3000) | Methylethylketone | — | 5 | 0.31 |
| Comparative Example 1 | Supporting plate A | Polystyrene | Methylethylketone | — | 5 | 0.03 |
| Comparative Example 2 | Supporting plate D | Polystyrene | Methylethylketone | — | 10 | 0.45 |

Examples 11 to 20 and Comparative Examples 3 and 4

(Formation of Backcoat Layer (Organic Polymer Layer)]

An organic polymer layer was formed on the face of the supporting plate opposite to the recording layer (rear face), by preparing a backcoat solution in the following composition, coating in on each of the supporting plates A to D thus prepared while varying the coating amount by controlling the wet amount thereof, i.e., by adjusting the groove depth of the coater, and then, drying the coated film in an oven at 150° C. for 30 seconds. The amounts of the films formed after drying are summarized in the following Table 2. A matting agent was added only in Examples 14 and 19.

Backcoat Solution

| | |
|---|---|
| Organic polymer (compound shown in Table 2) | 25 g |
| Surfactant (fluorochemical surfactant B, in the structure above) | 0.05 g |
| Solvent (compound shown in Table 2) | 100 g |
| Matting agent (long-chain alkyl group-containing polymer A in the structure above) | 2.0 g |

In Example 15, the backcoat solution described above coated on the aluminum plate was dried not in the oven but in the continuous coating drier shown in FIG. 1.

In Examples 11 and 20, a matt layer is formed on the surface of the organic polymer layer by the following method after the organic polymer layer above is formed in a similar manner to Examples 1 and 10.

[Formation of Recording Layer (Single Layer)]

The following recording layer-coating solution 3 was coated on the surface of the supporting plate opposite to the organic polymer layer formed and dried in an oven at 1 50° C. for 1 minute, forming a photosensitive planographic printing plate precursor of each of Examples 11 to 20 and Comparative Examples 3 and 4 having a positive-type recording layer at a film thickness of 2.0 g/m$^2$ after drying.

<Recording Layer Coating Solution 3>

| | |
|---|---|
| m,p-Cresol novolak (m/p ratio: 6/4, weight-average molecular weight: 7,500, unreacted cresol content: 0.5 wt %) | 0.90 g |
| Methacrylic acid/ethyl methacrylate/isobutyl methacrylate copolymer (molar ratio: 26/37/37) | 0.10 g |
| Cyanine dye A (in the structure above) | 0.04 g |
| 2,4,6-Tris(hexyloxy)benzenediazonium-2-hydroxy-4-methoxybenzophenone-5-sulfonate | 0.01 g |
| p-Toluenesulfonic acid | 0.002 g |
| Tetrahydrophthalic anhydride | 0.05 g |
| Victoria Pure Blue BOH dye having 1-naphthalenesulfonate as the counter anion | 0.015 g |
| Fluorochemical surfactant (Magafac F-176, manufactured by Dainippon Ink and Chemicals, Inc.) | 0.02 g |
| Methylethylketone | 15 g |
| 1-Methoxy-2-propanol | 7 g |

TABLE 2

| | Supporting plate | Organic polymer | Solvent | Matting agent | Coating amount of organic polymer layer (g/m$^2$) | Arithmetic mean roughness Ra (μm) |
|---|---|---|---|---|---|---|
| Example 11 | Supporting plate A | Polystyrene | Methylethylketone | — | 5 | 0.18 |
| Example 12 | Supporting plate B | Polystyrene | Methylethylketone | — | 10 | 0.22 |
| Example 13 | Supporting plate C | Polystyrene | Methylethylketone | — | 3 | 0.38 |
| Example 14 | Supporting plate A | Polystyrene | Methylethylketone | Long-chain alkyl group-containing polymer A | 12 | 0.25 |
| Example 15 | Supporting plate A | Polystyrene | Methylethylketone | — | 8 | 0.41 |
| Example 16 | Supporting plate A | Polyethylene terephthalate | 1,1,1,3,3,3-Hexafluoro-2-propanol | — | 7 | 0.15 |
| Example 17 | Supporting plate B | Saturated polyester resin (Chemit K-288) | Methylethylketone | — | 5 | 0.22 |
| Example 18 | Supporting plate C | Epoxy resin (Epikote 1001) | Methylethylketone | — | 5 | 0.35 |
| Example 19 | Supporting plate A | Vinylidene chloride-acrylonitrile copolymer resin (Saran F-310) | Methylethylketone | Long-chain alkyl group-containing polymer A | 5 | 0.17 |
| Example 20 | Supporting plate A | Polyvinylbutyral resin (Denka Butyral K-3000) | Methylethylketone | — | 5 | 0.31 |
| Comparative Example 3 | Supporting plate A | Polystyrene | Methylethylketone | — | 5 | 0.03 |
| Comparative Example 4 | Supporting plate D | Polystyrene | Methylethylketone | — | 10 | 0.45 |

<Measurement of the Arithmetic Mean Roughness Ra of Organic Polymer Layer (Backcoat Layer)>

The arithmetic mean roughness Ra of the backcoat layer (organic polymer layer) on each of the infrared-sensitive planographic printing plate precursors obtained in Examples and Comparative Examples was determined by using a needle profilometer. Measurement results are summarized in Tables 1 and 2.

[Evaluation]

The following items, "1. scratching during transportation", "2. presence of adhesion", and "3. scratching in auto-loader" of each of the infrared-sensitive planographic printing plate precursors obtained in Examples and Comparative Examples were evaluated.

1. Evaluation of Scratching During Transportation

Each of the infrared-sensitive planographic printing plate precursors obtained was cut into pieces of 1,030 mm×800 mm in size, and 30 pieces thereof were used. The 30 plates were stacked without insert paper; cardboards having a thickness of 0.5 mm was place at the top and bottom thereof; and the four corners were bonded with a tape and wrapped with an aluminum Kraft paper. It was then placed in a corrugated case and bonded with a tape, giving an insert paper-free package. The package was placed on a pallet, transported for a distance of 2,000 km, and then, opened. An infrared-sensitive planographic printing plate precursor separated was immersed at a ratio of 1:8 in a developing solution DT-2 manufactured by Fuji Photo Film Co. in an automatic developing machine LP-940HII manufactured by Fuji Photo Film Co., and developed at a developing temperature of 32° C. and a developing period of 12 seconds. The electric conductivity of the developing solution then was 43 mS/cm. The loss of image region after development due to scratching on the recording layer of the planographic printing plate during transportation was evaluated by visual observation.

Planographic printing plates without loss of image region were ranked "G1"and those with loss of the image region "G2". Results are summarized in Table 3.

2. Evaluation of Presence of Adhesion

The presence or absence of the adhesion between planographic printing plate precursors was evaluated according to the following method: An infrared-sensitive planographic printing plate precursor obtained was cut into pieces of 1,030 mm×800 mm in size and 1,500 pieces of them were used. The 1,500 plates were stacked without insert paper; iron plates are placed at the top and bottom of the pile and fastened by screwing; and the stacked plates were left in a stock yard for a month in summer (in July) in the shape for mass transportation. After storage, the iron plates were separated, and the adhesion between the planographic printing plate precursors was evaluated by visual observation.

Planographic printing plates without adhesion were ranked "G1", and those with adhesion "G2". Results are summarized in Table 3.

3. Evaluation of Scratching in Auto-loader

Ten planographic printing plate precursors in the same size as above were placed in the cassette of a Luxel T-9800 CTP single auto-loader without insert paper, automatically supplied onto the drum, discharged without light exposure, and developed with a developing solution DT-2 manufactured by Fuji Photo Film Co. (diluted at 1:8 ratio) and a finisher FG-1 manufactured by Fuji Photo Film Co. (diluted at 1:1 ratio) in an automatic developer LP-940HII manufactured by Fuji Photo Film Co., at a developing temperature of 32° C. and a developing period of 12 seconds. The electric conductivity of the developing solution then was 43 mS/cm. Scratching by loading and unloading of the planographic printing plate in the auto-loader was evaluated after development by visual observation.

Planographic printing plates without generation of scratch were ranked "G1", and those with generation of scratch "G2". Results are summarized in Table 3.

TABLE 3

| | Scratching during transportation | Presence of adhesion | Scratching in auto-loader |
|---|---|---|---|
| Example 1 | G1 | G1 | G1 |
| Example 2 | G1 | G1 | G1 |
| Example 3 | G1 | G1 | G1 |
| Example 4 | G1 | G1 | G1 |
| Example 5 | G1 | G1 | G1 |
| Example 6 | G1 | G1 | G1 |
| Example 7 | G1 | G1 | G1 |
| Example 8 | G1 | G1 | G1 |
| Example 9 | G1 | G1 | G1 |
| Example 10 | G1 | G1 | G1 |
| Example 11 | G1 | G1 | G1 |
| Example 12 | G1 | G1 | G1 |
| Example 13 | G1 | G1 | G1 |
| Example 14 | G1 | G1 | G1 |
| Example 15 | G1 | G1 | G1 |
| Example 16 | G1 | G1 | G1 |
| Example 17 | G1 | G1 | G1 |
| Example 18 | G1 | G1 | G1 |
| Example 19 | G1 | G1 | G1 |
| Example 20 | G1 | G1 | G1 |
| Comparative Example 1 | G1 | G2 | G1 |
| Comparative Example 2 | G2 | G1 | G2 |
| Comparative Example 3 | G1 | G2 | G1 |
| Comparative Example 4 | G2 | G1 | G2 |

As apparent from Table 3, the infrared-sensitive planographic printing plates (in Examples) having an arithmetic mean roughness Ra of the organic polymer layer in the range of the invention leave the plate materials unbonded to each other and reduce the adhesion failure and scratch even when they are stacked without insert paper. The infrared-sensitive planographic printing plates are also superior in the compatibility with the exposure device equipped with an auto-loader.

Examples 21 to 28 and Comparative Examples 5 and 6

(Preparation of Supporting Plate)

<Aluminum Plate>

A supporting plate was prepared in a similar manner to Example 1, except that the anodizing treatment (j) in preparation of the supporting plate of Example 1 was changed to the following method:

(j) Anodizing treatment

The backcoat layer-coated surface was anodized in an anodic oxidation apparatus in a two-stage power-supply electrolysis method (the length of the first and second electrolysis units: 6 m, the length of the first and second power-supply units: 3 m, and the length of the first and second power-supply electrode: 2.4 m). The electrolyte solutions supplied to the first and second electrolysis units were sulfuric acid solutions at concentrations shown in Table 1 at a temperature of 43° C. Subsequently, the aluminum plate was washed with water by spraying. The basis weight of the final anodic oxide film, as determined by fluorescent X-ray measurement, is shown in Table 4.

Subsequently, the recording layer-coating surface was anodized in an anodic oxidation apparatus (the length of the first and second electrolysis units: 6 m, the length of the first and second power-supply units: 3 m, and the first and second power-supply electrodes: 2.4 m) by the two-stage electric supply electrolysis method. The electrolyte solution supplied to the first and second electrolysis units was sulfuric acid. Each electrolyte solution was sulfuric acid at a concentration of 170 g/L (containing aluminum ion at 0.5 mass %) at a temperature of 43° C. The aluminum plate was then washed with water by spraying. The basis weight of the anodic oxide film formed, as determined by fluorescent X-ray measurement, was 2.7g/$m^2$.

[Formation of Backcoat Layer (Organic Polymer Layer)]

An organic polymer layer was formed on the face of the supporting plate obtained as described above opposite to the recording layer (rear face), by preparing a backcoat solution in the following composition containing a surfactant (fluorochemical surfactant B) and a solvent, coating in on the supporting plate while varying the coating amount by controlling the wet amount thereof, i.e., by adjusting the groove depth of the coater, and then, drying the coated film in an oven at 150° C. for 30 seconds. The coating amount after drying is shown in the following Table 4.

Backcoat Solution

| | |
|---|---|
| Organic polymer (compound shown in Table 4) | 25 g |
| Surfactant (fluorochemical surfactant B, having the following structure) | 0.05 g |
| Methylethylketone | 100 g |

Fluorochemical surfactant B

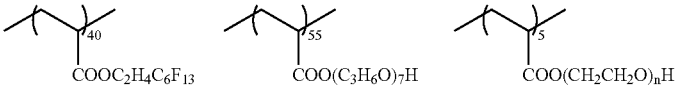

Mw: 35,000

<Formation of Organic Undercoat Layer>

An organic undercoat layer was formed in a similar manner to Example 1 on the surface of the supporting plate opposite to the organic polymer layer formed.

[Formation of Recording Layer (Multi-layered)]

A recording layer consisting of lower and upper layers was formed on an aluminum substrate having an organic undercoat layer formed in a similar manner to Example 1, except that the following coating solution for undercoat layer 4 was used.

<Coating Solution for Undercoat Layer 4>

| | |
|---|---|
| N-(4-Aminosulfonylphenyl)methacrylamide/acrylonitrile/methyl methacrylate (36/34/30: weight-average molecular weight: 60,000, acid value: 2.65) | 1.73 g |
| Novolak resin (2,3-xylenol/m-cresol/p-cresol ratio: 10/20/70, weight-average molecular weight: 3,300) | 0.192 g |
| Cyanine dye A (in the structure above) | 0.134 g |
| 4,4'-Bishydroxyphenylsulfone | 0.126 g |
| Tetrahydrophthalic anhydride | 0.190 g |
| p-Toluenesulfonic acid | 0.008 g |
| 3-Methoxy-4-diazodiphenylamine Hexafluorophosphate | 0.032 g |
| Ethyl violet having 6-hydroxynaphthalenesulfonate as the counter ion | 0.0781 g |
| Polymer 1 (in the structure above) | 0.035 g |
| Methylethylketone | 25.41 g |

-continued

| | |
|---|---|
| 1-Methoxy-2-propanol | 12.97 g |
| γ-Butylolactone | 13.18 g |

TABLE 4

| | Anodizing treatment | | Organic polymer layer (backcoat layer) | | |
|---|---|---|---|---|---|
| | Sulfuric acid concentration (g/L) | Basis weight of anodic oxide (g/$m^2$) | Organic polymer | Solvent | Coating amount (g/$m^2$) |
| Example 21 | 5 | 0.5 | Polystyrene | Methylethylketone | 2 |
| Example 22 | 20 | 1.5 | Polystyrene | Methylethylketone | 15 |
| Example 23 | 48 | 2.5 | Polystyrene | Methylethylketone | 5 |
| Example 24 | 20 | 1.5 | Polyethylene terephthalate | 1,1,1,3,3,3-Hexafluoro-2-propanol | 5 |
| Example 25 | 5 | 0.5 | Saturated polyester resin (Chemit K-588) | Methylethylketone | 3 |
| Example 26 | 12 | 1 | Epoxy resin (Epikote 1001) | Methylethylketone | 8 |
| Example 27 | 55 | 2.9 | Vinylidene chloride-acrylonitrile copolymer resin (Saran F-310) | Methylethylketone | 5 |
| Example 28 | 20 | 1.5 | Polyvinylbutyral resin (Denka Butyral K-3000) | Methylethylketone | 5 |
| Example 29 | 5 | 0.5 | Polystyrene | Methylethylketone | 2 |
| Comparative Example 5 | — | 0 | — | — | — |
| Comparative Example 6 | 0.35 | 0.04 | Polystyrene | Methylethylketone | 5 |

Example 29

A photosensitive planographic printing plate precursor having a positive-type recording layer at a dry film thickness of 2.0 g/m$^2$ of Example 29 was prepared, by coating the recording layer coating solution 3 of Example 11 on a supporting plate having an anodic oxide film and a backcoat layer (organic polymer layer) on the rear face similar to that in Example 21 and drying the film in an oven at 150° C. for 1 minute.

<Evaluation>

Two items, "1. presence of exfoliation of backcoat layer (organic polymer layer)"and "2. generation of damage (scratch) on the recoding layer during transportation" of each of the infrared-sensitive planographic printing plate precursors obtained in Examples and Comparative Examples were evaluated.

1. Evaluation of the Presence of Exfoliation of Backcoat Layer (Organic Polymer Layer)

Each of the infrared-sensitive planographic printing plate precursors obtained was cut into pieces of 1,030 mm×800 mm in size, and 30 pieces thereof were used. The 30 plates were stacked without insert paper; cardboards having a thickness of 0.5 mm was place at the top and bottom thereof, and the four corners were bonded with a tape and wrapped with an aluminum Kraft paper. It is placed in a corrugated case and bonded with a tape, giving an insert paper-free package. The package was placed on a pallet, transported for a distance of 2,000 km, and then, opened. Presence of exfoliation at the four corners of the backcoat layer of the planographic printing plate precursor after exfoliated was evaluated by visual observation.

Planographic printing plate precursors without exfoliation were ranked "G1"and those with exfoliation "G2". Results are summarized in Table 5.

2. Evaluation of Generation of the Damage (Scratch) on the Recording Layer During Transportation It is evaluated in a similar manner to Example 1. Results are summarized in Table 5.

TABLE 5

| | Exfoliation of backcoat layer | Scratching on recording layer |
|---|---|---|
| Example 21 | G1 | G1 |
| Example 22 | G1 | G1 |
| Example 23 | G1 | G1 |
| Example 24 | G1 | G1 |
| Example 25 | G1 | G1 |
| Example 26 | G1 | G1 |
| Example 27 | G1 | G1 |
| Example 28 | G1 | G1 |
| Example 29 | G1 | G1 |
| Comparative Example 5 | — | G2 |
| Comparative Example 6 | G2 | G1 |

As apparent from Table 5, no exfoliation of the backcoat layer (organic polymer layer) was observed in the infrared-sensitive planographic printing plates obtained in Examples, even when they are stacked without insert paper and the plate materials are rubbed by each other.

In addition, the infrared-sensitive planographic printing plates obtained in Examples had fewer damages (scratches) on the recording layer, even when they are stacked and packaged without insert paper.

What is claimed is:

1. An infrared-sensitive planographic printing plate precursor, comprising a supporting plate, a recording layer formed on one face of the supporting plate, the recording layer containing a water-insoluble and alkali-soluble resin and an infrared absorbent and being capable of forming an image by irradiation of an infrared ray, and an organic polymer layer having an arithmetic mean roughness Ra in the range of 0.05 to 0.40 μm formed on a face of the supporting plate opposite to the recording layer.

2. The infrared-sensitive planographic printing plate precursor of claim 1, wherein the organic polymer layer has a matt layer formed on a surface thereof.

3. The infrared-sensitive planographic printing plate precursor of claim 1, wherein the organic polymer layer comprises a matting agent.

4. The infrared-sensitive planographic printing plate precursor of claim 3, wherein the matting agent is a long-chain alkyl group-containing polymer.

5. The infrared-sensitive planographic printing plate precursor of claim 4, wherein the long-chain alkyl group-containing polymer is a polymer selected from polymers represented by the following Formulae (I), (II), (III), (IV) and (V):

Formula (I)

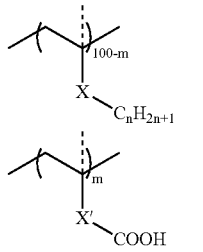

Formula (II)

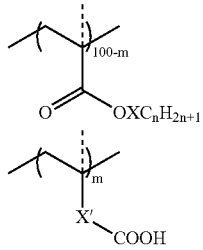

Formula (III)

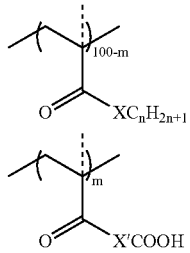

Formula (IV)

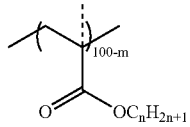

-continued

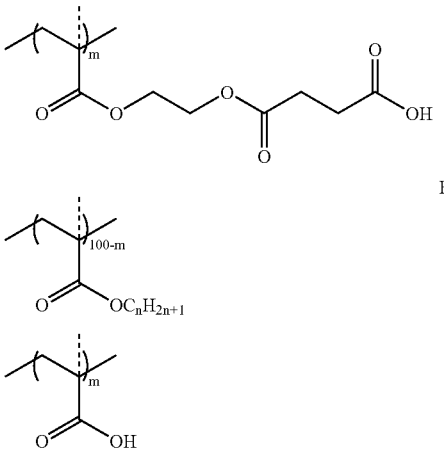

Formula (V)

wherein, X and X' each independently represent a bivalent connecting group; m is an integer of 20 to 99; n is an integer of 6 to 40; and a binding site indicated by a dotted line has a methyl group or a hydrogen atom at an end thereof.

6. The infrared-sensitive planographic printing plate precursor of claim 4, wherein the content of the long-chain alkyl group-containing polymer is 0.01 to 30 mass % with respect to the total solid content of the organic polymer layer.

7. The infrared-sensitive planographic printing plate precursor of claim 1, wherein the organic polymer layer is surface-roughened.

8. The infrared-sensitive planographic printing plate precursor of claim 1, wherein the arithmetic mean roughness Ra of the supporting plate is in the range of 0.01 to 0.60 μm.

9. An infrared-sensitive planographic printing plate precursor, comprising a supporting plate, a recording layer formed on one face of the supporting plate, the recording layer containing a water-insoluble and alkali-soluble resin and an infrared absorbent and being capable of forming an image by irradiation of an infrared ray, and an anodic oxide film having a basis weight of 0.05 to 3.0 $g/m^2$ and an organic polymer layer formed in that order on a face of the supporting plate opposite to the recording layer.

10. The infrared-sensitive planographic printing plate precursor of claim 9, wherein the basis weight of the anodic oxide film is in the range of 0.10 to 2.5 $g/m^2$.

* * * * *